US009671740B2

(12) United States Patent
Yoshikawa et al.

(10) Patent No.: US 9,671,740 B2
(45) **Date of Patent: *Jun. 6, 2017**

(54) PRINT CONTROL APPARATUS, PRINTING SYSTEM, AND PRINT CONTROL METHOD

(71) Applicant: Ricoh Company, Ltd., Tokyo (JP)

(72) Inventors: Takashi Yoshikawa, Kanagawa (JP); Hiroaki Suzuki, Chiba (JP); Hiroo Kitagawa, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/145,577

(22) Filed: May 3, 2016

(65) Prior Publication Data

US 2016/0246239 A1 Aug. 25, 2016

Related U.S. Application Data

(63) Continuation of application No. 14/577,698, filed on Dec. 19, 2014, now Pat. No. 9,354,582, which is a (Continued)

(30) Foreign Application Priority Data

Mar. 18, 2011 (JP) ..... 2011-061511
Mar. 13, 2012 (JP) ..... 2012-056467

(51) Int. Cl.
*G03G 15/20* (2006.01)
*G03G 15/00* (2006.01)

(52) U.S. Cl.
CPC ..... *G03G 15/6585* (2013.01); *G03G 15/50* (2013.01)

(58) Field of Classification Search
None
See application file for complete search history.

(56) References Cited

U.S. PATENT DOCUMENTS 7,024,149 B2 4/2006 Kito et al.
8,320,812 B2 11/2012 Kanno
(Continued)

FOREIGN PATENT DOCUMENTS

JP 3066995 5/2000
JP 2009-37102 2/2009
(Continued)

*Primary Examiner* — David Gray
*Assistant Examiner* — Geoffrey T Evans
(74) *Attorney, Agent, or Firm* — Oblon, McClelland, Maier & Neustadt, L.L.P.

(57) ABSTRACT

A print control apparatus includes a generating unit that generates clear-toner plane data based on gloss-control plane data, which contains a gloss control value for specifying a type of a surface effect being a visual or a tactile effect applied to the recording medium and for specifying a region to which the surface effect is applied in the recording medium, and clear plane data, which contains a density value for specifying a transparent image other than the surface effect; and an outputting unit that outputs the clear-toner plane data. When a region where the gloss control value is specified in the gloss-control plane data and a region where the density value is specified in the clear plane data overlap each other, the generating unit sets a value of the clear-toner plane data to the gloss control value or the density value, based on a predetermined condition.

12 Claims, 33 Drawing Sheets

Related U.S. Application Data continuation of application No. 13/422,840, filed on Mar. 16, 2012, now Pat. No. 8,934,827.

(56) References Cited

U.S. PATENT DOCUMENTS

| | | | |
|---|---|---|---|
| 8,593,681 | B2 | 11/2013 | Iguchi |
| 8,711,427 | B2 | 4/2014 | Tokushima et al. |
| 8,725,053 | B2 | 5/2014 | Mitsui et al. |
| 8,768,232 | B2 | 7/2014 | Yamamoto et al. |
| 8,934,827 | B2 | 1/2015 | Yoshikawa et al. |
| 9,229,407 | B1 | 1/2016 | Robinson |
| 2010/0196035 | A1 | 8/2010 | Takemura |
| 2011/0043840 | A1 | 2/2011 | Iinuma et al. |
| 2012/0062956 | A1 | 3/2012 | Kitagawa et al. |
| 2012/0063802 | A1 | 3/2012 | Suzuki et al. |
| 2012/0237247 | A1 | 9/2012 | Tokushima et al. |
| 2013/0063740 | A1 | 3/2013 | Mochizuki |
| 2013/0063741 | A1 | 3/2013 | Miyazaki et al. |
| 2013/0063785 | A1 | 3/2013 | Miyazaki et al. |
| 2013/0070260 | A1 | 3/2013 | Tokushima et al. |
| 2013/0070268 | A1 | 3/2013 | Yoshida et al. |
| 2013/0242350 | A1 | 9/2013 | Yoshida et al. |
| 2013/0250312 | A1 | 9/2013 | Miyazaki |
| 2013/0250365 | A1 | 9/2013 | Yoshida et al. |
| 2013/0265608 | A1 | 10/2013 | Yoshida et al. |
| 2013/0271778 | A1 | 10/2013 | Habu et al. |
| 2013/0271791 | A1 | 10/2013 | Miyazaki et al. |
| 2013/0271792 | A1 | 10/2013 | Awamura |
| 2013/0278943 | A1 | 10/2013 | Kurosawa et al. |
| 2013/0278952 | A1 | 10/2013 | Suzuki et al. |
| 2013/0278953 | A1 | 10/2013 | Yukie et al. |
| 2013/0279958 | A1 | 10/2013 | Yukie et al. |
| 2015/0110535 | A1 | 4/2015 | Kogusuri |
| 2015/0131113 | A1 | 5/2015 | Tsuwano |
| 2015/0138575 | A1 | 5/2015 | Takamizawa |
| 2015/0177671 | A1 | 6/2015 | Yoshida |
| 2015/0185678 | A1 | 7/2015 | Yoshida |
| 2015/0262047 | A1 | 9/2015 | Tsuwano |
| 2015/0346622 | A1 | 12/2015 | Itoh |

FOREIGN PATENT DOCUMENTS

| | | |
|---|---|---|
| JP | 2009-58941 | 3/2009 |
| JP | 2009-217083 | 9/2009 |

FIG.1
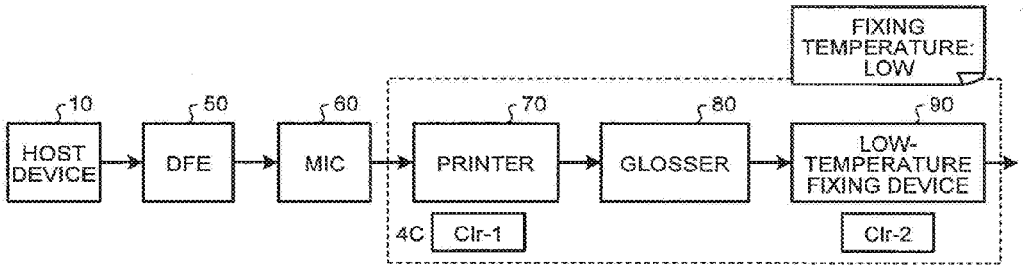
FIG.2
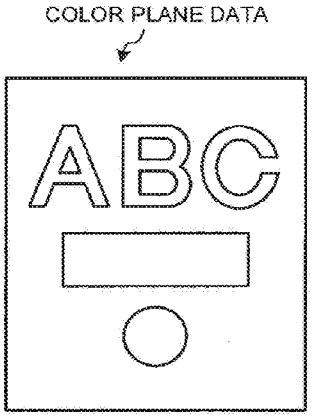
FIG.3
| NAME OF GLOSS CONTROL | GLOSS | DEVIATION |
|---|---|---|
| SPECULAR GLOSS (PG) | Gs≥80 | ΔGs≤10 |
| SOLID GLOSS (G) | Gs=Gs (SOLID GLOSS) | ΔGs≤10 |
| HALFTONE-DOT MATT (M) | Gs=Gs (1C WITH 30% OF HALFTONE DOTS) | ΔGs≤10 |
| MATT (PM) | Gs≤10 | ΔGs≤10 |

FIG.9

SET PLANE PRIORITY INFORMATION (●) PRIORITY ON GLOSS-CONTROL PLANE DATA ( ) PRIORITY ON CLEAR PLANE DATA

FIG.10

| TYPE OF SURFACE EFFECT SPECIFIED BY USER | DENSITY VALUE IN GLOSS-CONTROL PLANE DATA (%) |
|---|---|
| NO CONTROL | 0% |
| SPECULAR GLOSS TR (PG) | 98% TO 94% |
| SOLID GLOSS (G) | 90% TO 84% |
| BACKGROUND PATTERN | 34% TO 30% |
| HALFTONE-DOT MATT (M) | 16% TO 10% |
| MATT (PM) | 6% TO 2% |

| DRAWING OBJECT | COORDINATE | DENSITY VALUE |
|---|---|---|
| A, B, C | (x1, y1)-(x2, y2) | 98% |
| (TETRAGON) | (x3, y3)-(x4, y4) | 90% |
| ... | ... | ... |

FIG.16

| DENSITY (%) | DENSITY | | | EFFECT | GLOSSER ON/OFF (ON-OFF INFORMATION) | CLEAR-TONER PLANE DATA 1 (PRINTER) | CLEAR-TONER PLANE DATA 2 (LOW-TEMPERATURE FIXING DEVICE) |
|---|---|---|---|---|---|---|---|
| | REPRE-SENTATIVE VALUE | VALUE RANGE | | | | | |
| 98% | 250 | 248 | 255 | SPECULAR GLOSS TYPE A | ON | INVERSE MASK A | NO DATA |
| 96% | 245 | 243 | 247 | SPECULAR GLOSS TYPE B | ON | INVERSE MASK B | NO DATA |
| 94% | 240 | 238 | 242 | SPECULAR GLOSS TYPE C | ON | INVERSE MASK C | NO DATA |
| 92% | 235 | 233 | 237 | RESERVED | | | |
| 90% | 230 | 228 | 232 | SOLID GLOSS TYPE 1 | OFF | INVERSE MASK 1 | NO DATA |
| 88% | 224 | 222 | 227 | SOLID GLOSS TYPE 2 | OFF | INVERSE MASK 2 | NO DATA |
| 86% | 219 | 217 | 221 | SOLID GLOSS TYPE 3 | OFF | INVERSE MASK 3 | NO DATA |
| 84% | 214 | 212 | 216 | SOLID GLOSS TYPE 4 | OFF | INVERSE MASK 4 | NO DATA |
| 82% | 209 | 207 | 211 | RESERVED | | | |
| 46% | 117 | 115 | 119 | RESERVED | | | |
| 44% | 112 | 110 | 114 | WATERMARK CHARACTER 3 (XXX) | OFF | NO DATA | TILE STRING 3 |
| 42% | 107 | 105 | 109 | WATERMARK CHARACTER 2 (COPY PROHIBITED) | | NO DATA | TILE STRING 2 |
| 40% | 102 | 100 | 104 | WATERMARK CHARACTER 1 (SAMPLE) | | NO DATA | TILE STRING 1 |
| 38% | 97 | 95 | 99 | RESERVED | | | |
| 36% | 92 | 90 | 94 | RESERVED | | | |
| 34% | 87 | 85 | 89 | BACKGROUND PATTERN 3 (XXX) | | NO DATA | TILE BACKGROUND PATTERN 3 |
| 32% | 82 | 80 | 84 | BACKGROUND PATTERN 2 (LATTICE) | | NO DATA | TILE BACKGROUND PATTERN 2 |
| 30% | 76 | 74 | 79 | BACKGROUND PATTERN 1 (WAVE) | | NO DATA | TILE BACKGROUND PATTERN 1 |
| 28% | 71 | 69 | 73 | RESERVED | | | |
| 26% | 66 | 64 | 68 | RESERVED | | | |
| 24% | 61 | 59 | 63 | TEXTURE PATTERN TYPE 3 (ROUGH) | | NO DATA | TILE MESH PATTERN 3 |
| 22% | 56 | 54 | 58 | TEXTURE PATTERN TYPE 2 (MODERATE) | | NO DATA | TILE MESH PATTERN 2 |
| 20% | 51 | 49 | 53 | TEXTURE PATTERN TYPE 1 (FINE) | | NO DATA | TILE MESH PATTERN 1 |
| 18% | 46 | 44 | 48 | RESERVED | | | |
| 16% | 41 | 39 | 43 | HALFTONE-DOT MATT TYPE 4 | OFF | HALFTONE 4 | NO DATA |
| 14% | 36 | 34 | 38 | HALFTONE-DOT MATT TYPE 3 | OFF | HALFTONE 3 | NO DATA |
| 12% | 31 | 29 | 33 | HALFTONE-DOT MATT TYPE 2 | OFF | HALFTONE 2 | NO DATA |
| 10% | 25 | 23 | 28 | HALFTONE-DOT MATT TYPE 1 | OFF | HALFTONE 1 | NO DATA |
| 8% | 20 | 18 | 22 | RESERVED | | | |
| 6% | 15 | 13 | 17 | MATT TYPE C | ON & OFF | NO DATA | SOLID |
| 4% | 10 | 8 | 12 | MATT TYPE B | ON & OFF | NO DATA | SOLID |
| 2% | 5 | 1 | 7 | MATT TYPE A | ON & OFF | NO DATA | SOLID |
| 0% | 0 | 0 | 0 | NOTHING | OFF | NO DATA | NO DATA |

FIG.20

| PLANE PRIORITY INFORMATION | CLEAR PLANE PIXEL DATA | GLOSS-CONTROL PLANE PIXEL DATA | PIXEL DATA GENERATED BY CLEAR-TONER PLANE DATA GENERATING UNIT (8-BIT) |
|---|---|---|---|
| PRIORITY ON GLOSS-CONTROL PLANE DATA | 0 | 0 | 0 |
| | A | 0 | A |
| | 0 | B | B |
| | A | B | B |
| PRIORITY ON CLEAR PLANE DATA | 0 | 0 | 0 |
| | A | 0 | A |
| | 0 | B | B |
| | A | B | A |

FIG.21

PRIORITY ON CLEAR PLANE DATA

| CLEAR PLANE DATA | GLOSS-CONTROL PLANE DATA | CLEAR-TONER PLANE DATA |
|---|---|---|
| 0 | 0 (NO CONTROL) | 0 |
| 0 | 98 TO 84% (GLOSS) | VALUE OF INVERSE MASK |
| 0 | 6 TO 2% (MATT) | DEFINED VALUE OF MATT |
| 0 | 34 TO 30% (BACKGROUND PATTERN) | DEFINED VALUE OF BACKGROUND PATTERN |
| 255 | 0 (NO CONTROL) | 255 |
| 255 | 98 TO 84% (GLOSS) | 255 |
| 255 | 6 TO 2% (MATT) | 255 |
| 255 | 34 TO 30% (BACKGROUND PATTERN) | 255 |

FIG.22

PRIORITY ON GLOSS-CONTROL PLANE DATA

| CLEAR PLANE DATA | GLOSS-CONTROL PLANE DATA | CLEAR-TONER PLANE DATA |
|---|---|---|
| 0 | 0 (NO CONTROL) | 0 |
| 0 | 98 TO 84% (GLOSS) | VALUE OF INVERSE MASK |
| 0 | 6 TO 2% (MATT) | DEFINED VALUE OF MATT PATTERN |
| 0 | 34 TO 30% (BACKGROUND PATTERN) | DEFINED VALUE OF BACKGROUND PATTERN |
| 255 | 0 (NO CONTROL) | 255 |
| 255 | 98 TO 84% (GLOSS) | 255 |
| 255 | 6 TO 2% (MATT) | MATT DATA |
| 255 | 34 TO 30% (BACKGROUND PATTERN) | BACKGROUND PATTERN DATA |

FIG.34

| PLANE PRIORITY INFORMATION | PRIORITY ORDER OF PLANE DATA AND SURFACE EFFECT |
|---|---|
| PRIORITY ORDER A | MATT>CLEAR IMAGE DATA> BACKGROUND PATTERN |
| PRIORITY ORDER B | BACKGROUND PATTERN> CLEAR IMAGE DATA>MATT |
| PRIORITY ORDER C | MATT OR BACKGROUND PATTERN>CLEAR IMAGE DATA |
| PRIORITY ORDER D | CLEAR IMAGE DATA>MATT OR BACKGROUND PATTERN |

FIG.35

IN CASE OF PRIORITY ORDER A

| CLEAR PLANE DATA | GLOSS-CONTROL PLANE DATA | CLEAR-TONER PLANE DATA |
|---|---|---|
| 0 | 0 (NO CONTROL) | 0 |
| 0 | 98 TO 84% (GLOSS) | VALUE OF INVERSE MASK |
| 0 | 6 TO 2% (MATT) | DEFINED VALUE OF MATT |
| 0 | 34 TO 30% (BACKGROUND PATTERN) | DEFINED VALUE OF BACKGROUND PATTERN |
| 255 | 0 (NO CONTROL) | 255 |
| 255 | 98 TO 84% (GLOSS) | GLOSS |
| 255 | 6 TO 2% (MATT) | MATT |
| 255 | 34 TO 30% (BACKGROUND PATTERN) | 255 |

| REGION | COORDINATE OF REGION | SPECIFICATION OF PRIORITY |
|---|---|---|
| REGION A | (0, 0, 4800, 5000) | PRIORITY ON GLOSS-CONTROL PLANE DATA |
| REGION B | (0, 5000, 4800, 6800) | PRIORITY ON CLEAR PLANE DATA |

PRINT CONTROL APPARATUS, PRINTING SYSTEM, AND PRINT CONTROL METHOD

CROSS-REFERENCE TO RELATED APPLICATIONS

The present application is a continuation of U.S. application Ser. No. 14/577,698, filed Dec. 19, 2014, which is a continuation of application Ser. No. 13/422,840, filed Mar. 16, 2012, which claims priority to Japanese Patent Application No. 2011-061511 filed on Mar. 18, 2011 and Japanese Patent Application No. 2012-056467 filed on Mar. 13, 2012, the entire content of each of which are incorporated herein by reference.

BACKGROUND OF THE INVENTION

1. Field of the Invention

The present invention relates to a print control apparatus, a printing system, and a print control method.

2. Description of the Related Art

There has been a known printing method, in which a color image as a target image of color printing is formed with color toners of C (cyan), M (magenta), Y (yellow), and K (black) and a corporate logo etc. is superimposed on the target color image such that the logo etc. does not influence the target color image nor stand out. To prevent the superimposed logo etc. from standing out, printing is performed by using a clear toner that is colorless and transparent and adding gloss so that the visibility can be obtained without colors. The superimposed image as mentioned above is called a watermark.

Meanwhile, a primary target image to be printed is generally a black or color image, but in some cases, printing is performed so as to set a gloss effect or a matt effect to a part of the target image. To set the surface effect as mentioned above, the clear toner is used. If the amount of toner attached to a region of an image is uniform, the surface of the region becomes glossy. If the amount of toner in the region is not uniform with only the CMYK toners, gloss can be set to the surface by adding a certain amount of the clear toner needed to make the amount of toner in the region uniform.

There has been a known technology for obtaining gloss by using the clear toner in a region that is not glossy because toner is non-uniformly attached to the region. For example, Japanese Patent No. 3066995 discloses a technology for realizing a gloss tone by forming an image with a constant amount of transparent toner (clear toner) in a region where the gloss is desired.

On the other hand, it is possible to realize the matt effect by adding the clear toner to color toners, such as the CMYK toners, so as to purposely generate irregularity to vary the amount of the attached toner over the region.

In general, the corporate logo etc. as mentioned above is independent of the primary target color image, is provided as a simple cell pattern repeatedly placed on the entire surface, and is arranged independently of the primary target color image of the printed matter. Therefore, the primary color image and the corporate logo often overlap each other at some portions, where a conflict occurs between the above-mentioned two types of methods of using the clear toner.

However, when the matt effect is desired in any region of a color image and if a part of the corporate logo overlaps the region, it is necessary to determine whether to give priority to the effect on the color image with sacrifice of the corporate logo or to give priority to the corporate logo with sacrifice of the effect on the color image. Specifically, there is a demand to perform exclusion control related to a clear-toner application method in an overlapping area of a region where a glossy and transparent image is provided and a region where a gloss or matt is applied to the color image.

Therefore, there is a need for a print control apparatus, a printing system, and a print control method capable of efficiently perform exclusion control related to the clear-toner application method in an overlapping area of a region where a glossy and transparent image appears and a region where the surface effect is applied to the color image.

SUMMARY OF THE INVENTION

According to an embodiment, there is provided a print control apparatus that controls a printing device. The printing device stores therein least one color toner and at least one colorless clear toner and forms an image on a recording medium based on color plane data for attaching the color toner and clear-toner plane data for attaching the clear toner. The print control apparatus includes a generating unit, and an outputting unit. The generating unit generates the clear-toner plane data based on gloss-control plane data and clear plane data. The gloss-control plane data contains a gloss control value for specifying a type of a surface effect being a visual or tactile effect applied to the recording medium and for specifying a region to which the surface effect is applied in the recording medium. The clear plane data contains a density value for specifying a transparent image other than the surface effect. The outputting unit outputs the clear-toner plane data. When a region where the gloss control value is specified in the gloss-control plane data and a region where the density value is specified in the clear plane data overlap each other, the generating unit sets a value of the clear-toner plane data to either the gloss control value specified in the gloss-control plane data or the density value specified in the clear plane data, based on a predetermined condition.

According to another embodiment, there is provided a printing system that includes an information processing apparatus, a printing device, and a print control apparatus that is connected to the information processing apparatus and the printing apparatus via a network and controls the printing device. The information processing apparatus includes an input unit, a first generating unit, and a first transmitting unit. The input unit receives specification of a color, specification of a type of a surface effect that is a visual or a tactile effect, and specification of a region to which the surface effect is applied, with respect to image data to be input. The first generating unit generates color plane data, gloss-control plane data, and clear plane data in accordance with the specifications received by the input unit. The color plane data is used to attach color toner to a recording medium. The gloss-control plane data is used to generate clear-toner plane data to attach colorless clear toner to the recording medium and contains a gloss control value for specifying a type of the surface effect applied to the recording medium and for specifying a region to which the surface effect is applied in the recording medium. The clear plane data contains a density value for specifying a transparent image other than the surface effect. The first transmitting unit transmits the color plane data, the gloss-control plane data, and the clear plane data to the print control apparatus. The print control apparatus includes a second generating unit that generates the clear-toner plane data based on the gloss-control plane data and the clear plane data; and a second transmitting unit that transmits the clear-toner plane data to the printing device. When a region where the gloss control value is specified in the gloss-control plane data and a region where the density value is specified in the clear plane data overlap each other, the second generating unit sets a value of the clear-toner plane data to either the gloss control value specified in the gloss-control plane data or the density value specified in the clear plane data, based on a predetermined condition. The printing device stores therein at least one color toner and at least one colorless clear toner and includes an image forming unit that forms an image on a recording medium based on the color image data and the clear-toner plane data.

According to still another embodiment, there is provided a print control method implemented by a print control apparatus that controls the printing device. The printing device stores therein at least one color toner and at least one colorless clear toner and forms an image on a recording medium based on color plane data used for attaching the color toner and clear-toner plane data for attaching the clear toner. The print control method includes generating the clear-toner plane data based on gloss-control plane data and clear plane data, the gloss-control plane data containing a gloss control value for specifying a type of a surface effect being a visual or a tactile effect applied to the recording medium and for specifying a region to which the surface effect is applied in the recording medium, and the clear plane data containing a density value for specifying a transparent image other than the surface effect; and outputting the clear-toner plane data. The generating includes setting, when a region where the gloss control value is specified in the gloss-control plane data and a region where the density value is specified in the clear plane data overlap each other, a value of the clear-toner plane data to either the gloss control value specified in the gloss-control plane data or the density value specified in the clear plane data, based on a predetermined condition.

The above and other objects, features, advantages and technical and industrial significance of this invention will be better understood by reading the following detailed description of presently preferred embodiments of the invention, when considered in connection with the accompanying drawings.

BRIEF DESCRIPTION OF THE DRAWINGS

FIG. 1 is a diagram of a configuration example of an image forming system according to a first embodiment;

FIG. 2 is a diagram illustrating an example of color plane data;

FIG. 3 is a diagram illustrating exemplary types of surface effects related to presence or absence of gloss;

FIG. 9 is a diagram illustrating an example of a screen for setting plane priority information;

FIG. 10 is a diagram illustrating an example of a density-value selection table;

FIG. 16 is a schematic diagram illustrating an exemplary data structure of a surface-effect selection table;

FIG. 20 is a diagram for explaining pixel data of an overlapping area generated in accordance with plane priority information;

FIG. 21 is a diagram illustrating examples of a value of clear plane data, a value of gloss-control plane data, and a value of clear-toner plane data generated based on the clear plane data and the gloss-control plane data when the plane priority information indicates that priority is given to the clear plane data;

FIG. 22 is a diagram illustrating examples of a value of the clear plane data, a value of the gloss-control plane data, and a value of the clear-toner plane data generated based on the clear plane data and the gloss-control plane data when the plane priority information indicates that priority is given to the gloss-control plane data;

FIG. 34 is an explanatory diagram illustrating details of plane priority information according to a second embodiment;

FIG. 35 is a diagram illustrating a concrete example of settings when the plane priority information indicates "priority order A";

DETAILED DESCRIPTION OF THE PREFERRED EMBODIMENTS

Figure 4:
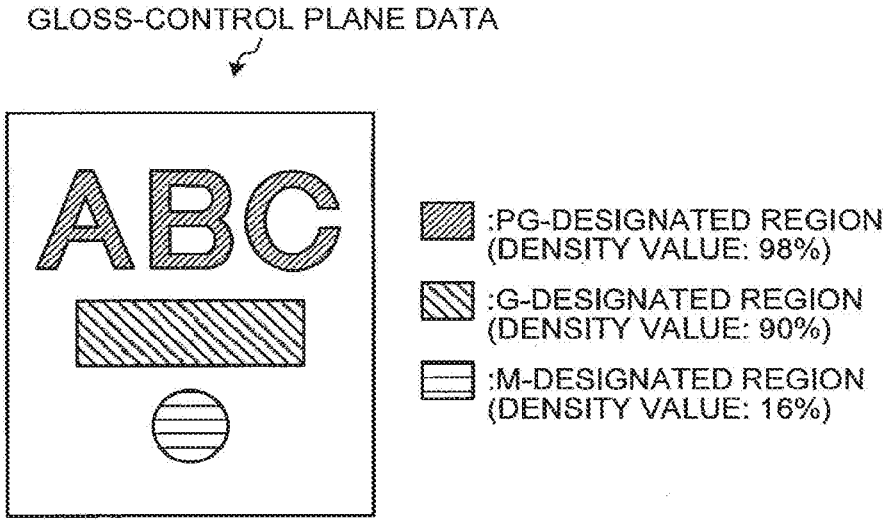
FIG. 4 is a diagram illustrating an image of gloss-control plane data.

Exemplary embodiments will be explained in detail below with reference to the accompanying drawings.

First Embodiment

A configuration of an image forming system according to a first embodiment will be explained below with reference to FIG. 1. In the present embodiment, the image forming system includes a printer control device (a Digital Front End (DFE)) 50 (hereinafter, described as "the DFE 50"), an interface controller (Mechanism I/F controller (MIC)) 60 (hereinafter, described as "the MIC 60"), a printer 70, a glosser 80 as a post processing device, and a low-temperature fixing device 90 as a post processing device, which are connected to one another. The DFE 50 communicates with the printer 70 via the MIC 60 and controls image formation performed by the printer 70. The DFE 50 is connected to a host device 10, such as a personal computer (PC); receives image data from the host device 10; generates image data, which is to be used by the printer 70 to form toner images corresponding to CMYK toners and a clear toner, by using the received image data; and sends the image data to the printer 70 via the MIC 60. The printer 70 is equipped with at least the CMYK toners and the clear toner. The printer 70 includes image forming units for the respective toners, each of which includes a photosensitive element, a charging unit, a developing unit, and a photosensitive-element cleaner; an exposing unit; and a fixing unit.

The clear toner is a transparent (colorless) toner that does not contain a color material. The transparent (colorless) indicates that, for example, transmittance is 70% or greater.

The printer 70 forms toner images of the respective toners on the photosensitive elements by applying light beams from the exposing unit in accordance with the image data sent from the DFE 50 via the MIC 60; transfers the toner images to a sheet of paper that is a recording medium; and fixes the toner images to the sheet by applying heat and pressure at a temperature in a predetermined range (a normal temperature) by using the fixing unit. As a result, an image is formed on the sheet. The configuration of the printer 70 as described above is widely known; therefore, detailed explanation thereof will be omitted. The sheet of paper is one example of the recording medium. The recording medium is not limited to the sheet of paper. For example, a sheet of synthetic paper or plastic sheet can also be used.

The glosser 80 is controlled to be on or off by on-off information specified by the DFE 50. When turned on, the glosser 80 applies pressure at high temperature and high pressure to the image that the printer 70 has formed on the sheet. Thereafter, the sheet having the image formed thereon is cooled and then removed from the main body of the glosser 80. Consequently, the total amount of toner attached to each pixel, on which more than a predetermined amount of toner has been attached, can be uniformly compressed over the whole image generated on the sheet. The low-temperature fixing device 90 includes a clear toner image forming unit having a photosensitive element, a charging unit, a developing unit, and a photosensitive-element cleaner; an exposing unit; and a fixing unit for fixing a clear toner, and receives image data of a clear toner plane generated by the DFE 50 for use by the low-temperature fixing device 90, which will be described below. When the DFE 50 generates the image data of the clear toner plane (hereinafter, described as "clear-toner plane data") to be used by the low-temperature fixing device 90, the low-temperature fixing device 90 generates a toner image with the clear toner by using the image data, superimposes the toner image on the sheet to which the pressure has been applied by the glosser 80, and fixes the toner image by applying lower heat or pressure than normal by using the fixing unit.

Image data (original data) input from the host device 10 will be explained below. The host device 10 generates image data by a pre-installed image processing application (an image processing unit 120, a plane-data generating unit 122, a print-data generating unit 123, or the like, which will be described below) and sends the image data to the DFE 50. The image processing application as above can handle image data of a special color plane (hereinafter, described as "special-color plane data") with respect to image data of each color plane, such as an RGB plane or a CMYK plane, in which a value of density (described as a "density value") of each color is defined for each pixel. The special-color plane data is image data used for adding a special toner or ink, such as white, gold, or silver, in addition to basic colors, such as CMYK or RGB. The special-color plane data is data used by a printer equipped with a special toner or ink. The special-color plane data may be used for adding R to CMYK basic colors or adding Y to RGB basic colors in order to improve color reproducibility. In general, the clear toner has been handled as one of the special colors.

In the embodiments, the clear toner as the special color is used for forming a certain surface effect, which is a visual or tactile effect to be added to a sheet of paper, and to form a transparent image, such as a watermark or a texture, other than the above surface effect.

Therefore, the image processing application installed in the host device 10 generates image data of a color plane (hereinafter, described as "color plane data") and also generates image data of a gloss control plane (hereinafter, described as "gloss-control plane data") and/or image data of a clear plane (hereinafter, described as "clear plane data") as the special-color image data according to specifications made by a user, with respect to the input image data.

The color image data is image data in which a density value of a color, such as RGB or CMYK, is defined for each pixel. In the color plane data, one pixel is represented by 8 bits according to a color specified by a user. FIG. 2 is a diagram illustrating an example of the color plane data. In FIG. 2, a density value corresponding to the color specified by a user via the image processing application is applied to each of drawing objects, such as "A", "B", and "C".

The gloss-control plane data is image data in which a region to which a surface effect is to be applied and a type of the surface effect are specified in order to control adhesion of the clear toner in accordance with the surface effect that is a visual or a tactile effect to be applied to a sheet.

In the gloss-control plane data, each pixel is represented by a density value in a range from "0" to "255" using 8 bits, similarly to the color plane data of RGB or CMYK. A type of the surface effect is associated with the density value (the density value may be represented by 16 bits, 32 bits, or 0 to 100%). The same value is set to a range to which the same surface effect is to be applied, regardless of the density of the clear toner to be actually attached. Therefore, if needed, it is possible to easily identify the region from the image data even without data that indicates the region. That is, the gloss-control plane data represents the type of the surface effect and the region to which the surface effect is applied (it may be possible to additionally provide data indicating the region).

The host device 10 generates the gloss-control plane data in a vector format by setting a type of the surface effect, which is specified for each drawing object by a user via the image processing application, as a density value that is a gloss control value for each drawing object.

Each pixel contained in the gloss-control plane data corresponds to each pixel of the color plane data. In each image data, a density value of each pixel becomes a pixel value. The color plane data and the gloss-control plane data are constructed in page units.

As the types of the surface effects, there are mainly the following types: presence or absence of gloss; surface protection; a watermark with embedded information; and a texture. As the surface effect related to the presence or absence of the gloss, there are mainly the following four types as illustrated by example in FIG. 3: specular gloss (Premium Gloss (PG)); solid gloss (Gloss (G)); halftone-dot matt (Matt (M)); and matt (Premium Matt (PM)) in descending order of the level of gloss (glossiness). In the following, the specular gloss may be described as "PG", the solid gloss may be described as "G", the halftone-dot matt may be described as "M", and the matt may be described as "PM".

The specular gloss and the solid gloss are used for giving high level of gloss while the halftone-dot matt and the matt are used for reducing gloss. In particular, the matt is used for realizing lower glossiness than the glossiness of a normal sheet of paper. In the figure, the specular gloss indicates the glossiness Gs of 80 or greater, the solid gloss indicates the solid glossiness of a primary color or a secondary color, the halftone-dot matt indicates the glossiness of a primary color with 30% of halftone dots, and the matt indicates the glossiness of 10 or smaller. The deviation of the glossiness is represented by $\Delta Gs$ and set to 10 or smaller. For the above types of the surface effects, high density values are associated with the surface effect that gives high level of gloss, and low density values are associated with the surface effect that reduces gloss. Intermediate density values are associated with the other surface effects, such as the watermark and the texture. As the watermark, a character or a background pattern may be used. The texture represents a character or a pattern and gives a tactile effect in addition to a visual effect. For example, a stained glass pattern can be realized by a clear toner. The surface protection is realized by using the specular gloss or the solid gloss as a substitute for the surface protection. A region to which a surface effect is to be applied in an image represented by image data being a processing object and a type of the surface effect to be applied are specified by a user via the image processing application. The host device 10 that executes the image processing application generates the gloss-control plane data by setting a density value corresponding to the surface effect specified by the user to each drawing object contained in the region specified by the user. A correspondence relation between the density value and the type of the surface effect will be described later.

FIG. 4 is an explanatory diagram illustrating an example of the gloss-control plane data. In the example of the gloss-control plane data illustrated in FIG. 4, a case is illustrated that the surface effect "PG (specular gloss)" is applied to a drawing object "ABC", the surface effect "G (solid gloss)" is applied to a drawing object "a rectangle", and the surface effect "M (halftone-dot matt)" is applied to a drawing object "a circle". The density value set to each surface effect is determined in accordance with the type of the surface effect in a density-value selection table (see FIG. 10) to be described below.

Figure 5:
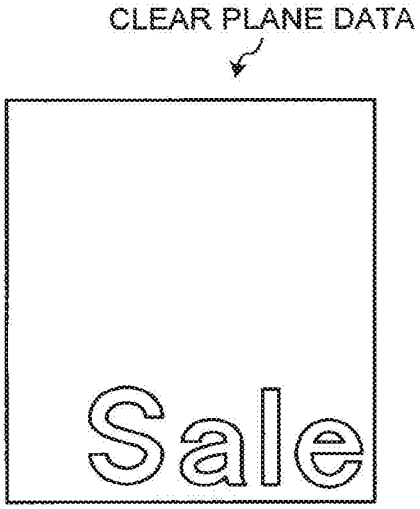
FIG. 5 is a diagram illustrating an example of clear plane data.

The clear plane data is image data in which a transparent image, such as a watermark or a texture, other than the surface effects described above is specified. FIG. 5 is an explanatory diagram illustrating an example of the clear-toner plane data. In the example illustrated in FIG. 5, a watermark "Sale" is specified by a user.

As described above, the gloss-control plane data and the clear plane data, which are the special-color image data, are generated by the image processing application of the host device 10 in planes separated from the plane of the color image data. A Portable Document Format (PDF) is used as the image data format of each of the color image data, the gloss-control plane data, and the clear plane data, and the pieces of the PDF image data are integrated into original data. The data format of the image data of each plane is not limited to PDF, and any formats may be used.

Figure 6:
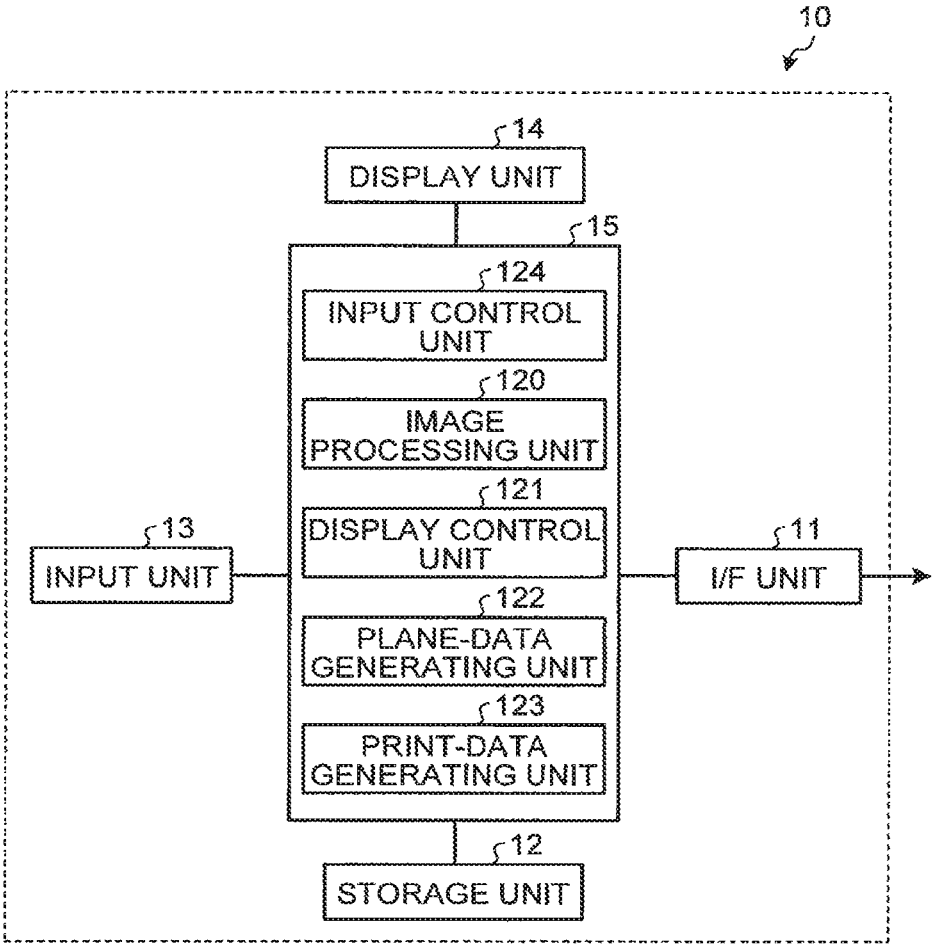
FIG. 6 is a block diagram of a schematic configuration example of a host device according to the first embodiment.

The host device 10 that generates image data of each plane as described above will be explained below. FIG. 6 is a block diagram of a schematic configuration example of the host device 10. As illustrated in FIG. 6, the host device 10 includes an I/F unit 11, a storage unit 12, an input unit 13, a display unit 14, and a control unit 15. The I/F unit 11 is an interface device for communicating with the DFE 50. The storage unit 12 is a recording medium, such as a hard disk drive (HDD) or a memory, for storing various types of data. The input unit 13 is an input device used for inputting various operations by a user and includes, for example, a keyboard or a mouse. The display unit 14 is a display device for displaying various screens and includes, for example, a liquid crystal panel.

The control unit 15 is a computer that controls the entire host device 10 and includes a CPU, a ROM, a RAM, and the like. As illustrated in FIG. 6, the control unit 15 mainly includes an input control unit 124, the image processing unit 120, a display control unit 121, the plane-data generating unit 122, and the print-data generating unit 123. The input control unit 124 and the display control unit 121 are realized by causing the CPU of the control unit 15 to read a program of an operating system stored in the ROM or the like, load the program to the RAM, and execute the loaded program. The image processing unit 120, the plane-data generating unit 122, and the print-data generating unit 123 are realized by causing the CPU of the control unit 15 to read a program of the image processing application stored in the ROM or the like, load the program to the RAM, and executes the loaded program. The plane-data generating unit 122 is provided as, for example, a plug-in function installed in the image processing application. It is possible to realize at least a part of the above units by an individual circuit (hardware).

The input control unit 124 receives various types of input from the input unit 13 and controls the input. For example, by operating the input unit 13, a user can input image specification information for specifying an image to which a surface effect is to be applied, i.e., color image data (hereinafter, appropriately described as a "target image") from among various images (for example, a photograph, a character, a figure, or a composite image containing a photograph, a character and a figure) stored in the storage unit 12. A method of inputting the image specification information is not limited to the above, and any arbitrary methods may be used.

The display control unit 121 controls display of various types of information on the display unit 14. According to the present embodiment, when the input control unit 124 receives the image specification information, the display control unit 121 reads an image specified in the image specification information from the storage unit 12 and causes the display unit 14 to display the read image on a screen.

A user can input specification information for specifying a region to which a surface effect is applied and a type of the surface effect by operating the input unit 13 while checking the target image displayed on the display unit 14. A method of inputting the specification information is not limited to the above, and any arbitrary methods may be used.

Figure 7:
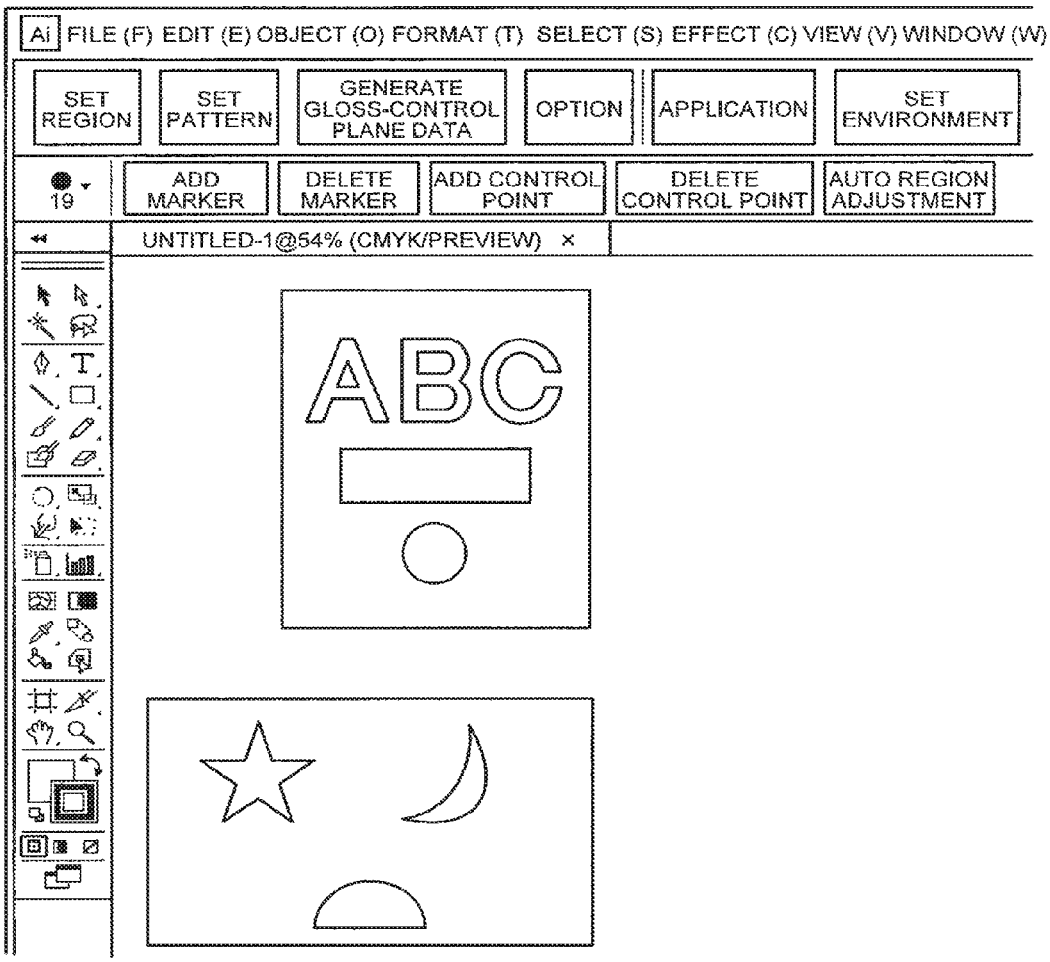
FIG. 7 is a diagram illustrating an example of a screen displayed by an image processing application.
Figure 8:
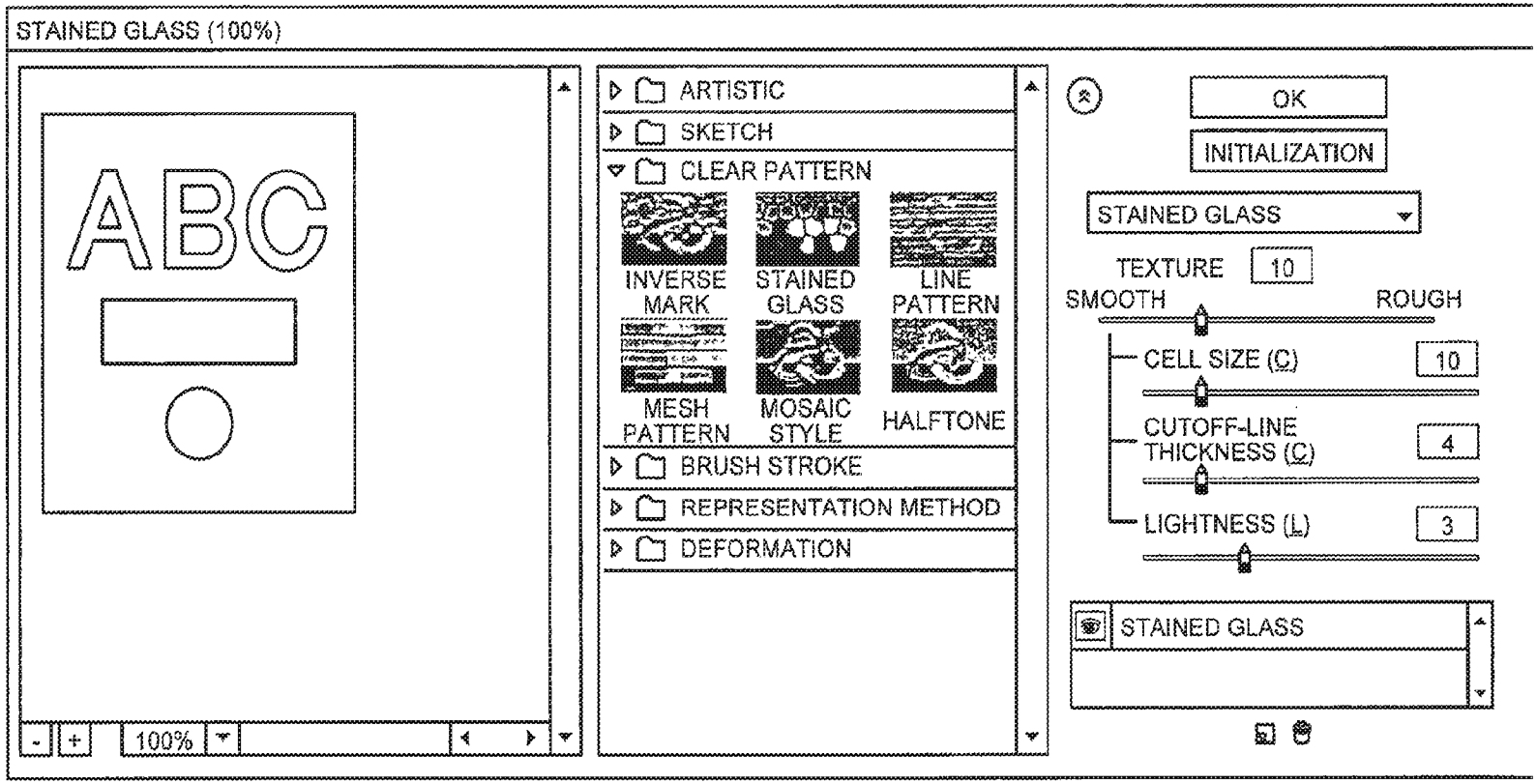
FIG. 8 is a diagram illustrating an example of a screen displayed by the image processing application.

More specifically, the display control unit 121 displays a screen as illustrated in FIG. 7 for example on the display unit 14. FIG. 7 illustrates an example of a screen that is displayed when plug-in is incorporated in Adobe Illustrator (Registered) marketed by Adobe Systems Inc. In the screen illustrated in FIG. 7, an image represented by target image data being a processing object (i.e., color plane data) is displayed. When a user inputs operation of specifying a region to which the surface effect is applied by pressing a marker addition button via the input unit 13, the region to which the surface effect is applied is specified. The user inputs the above operation for each of the regions to which a surface effect is applied. The display control unit 121 of the host device 10 displays a screen as illustrated in FIG. 8 for example on the display unit 14 for each specified region. In the screen illustrated in FIG. 8, an image of the region is displayed in each region that is specified as a target to which the surface effect is to be applied. By inputting the operation of specifying the type of the surface effect to be applied to the image via the input unit 13, it is possible to specify the type of the surface effect to be applied to the region. As the type of the surface effect, the specular gloss and the solid gloss in FIG. 3 are described as an "inverse mask" in FIG. 8 while the effects other than the specular gloss and the solid gloss in FIG. 3 are described as a stained glass, a line pattern, a mesh pattern, a mosaic style, a halftone-dot matt, and a halftone. It is also indicated that each surface effect can be specified.

The display control unit 121 of the host device 10 displays, on the display unit 14, options of plane priority information as illustrated by example in FIG. 9. A screen for setting the plane priority information allows a user to select whether to give priority to designation of a transparent image or designation of a surface effect when the transparent image and the surface effect are designated in an overlapping manner in an image to be printed. In the screen illustrated in FIG. 9, a user selects "priority on clear plane data" when giving priority to the specification of the transparent image and selects "priority on gloss-control plane data" when giving priority to the specification of the surface effect. The specification is sent to the DFE 50 together with print data.

Referring back to FIG. 6, the image processing unit 120 performs various types of image processing on the target image on the basis of an instruction received from the user via the input unit 13.

The plane-data generating unit 122 generates color plane data, gloss-control plane data, and clear plane data.

That is, when the input control unit 124 receives specification of a color of a drawing object in the target image from a user, the plane-data generating unit 122 generates color plane data in accordance with the specification of the color.

When the input control unit 124 receives specification of a transparent image, such as a watermark or a texture, other than the surface effect and specification of a region to which the transparent image is to be applied, the plane-data generating unit 122 generates clear plane data that specifies the transparent image and a region to which the transparent image is applied in a sheet of paper, in accordance with the specification made by the user.

When the input control unit 124 receives specification information (a region to which the surface effect is applied and a type of the surface effect), the plane-data generating unit 122 generates gloss-control plane data for specifying the region to which the surface effect is to be applied in the sheet and for specifying the type of the surface effect, on the basis of the specification information. At this time, the plane-data generating unit 122 generates the gloss-control plane data, in which a region to be applied with the surface effect indicated by the gloss control value is specified for each drawing object in the image data of the target image.

The storage unit 12 stores therein the density-value selection table that contains a type of a surface effect specified by a user and a density value corresponding to the type of the surface effect in the gloss-control plane data. FIG. 10 is a diagram illustrating an example of the density-value selection table. In the example in FIG. 10, "98%" is set to a density value corresponding to a region in which "PG" (specular gloss) is specified in the gloss-control plane data by the user; "90% is set to a density value corresponding to a region in which "G" (solid gloss) is specified in the gloss-control plane data"; "16%" is set to a density value corresponding to a region in which "M" (halftone-dot matt) is specified in the gloss-control plane data; and "6%" is set to a density value corresponding to a region in which "PM" (matt) is specified in the gloss-control plane data.

The density-value selection table is a part of data contained in a surface-effect selection table (to be described below) stored in the DFE 50. The control unit 15 acquires the surface-effect selection table at a predetermined timing, generates the density-value selection table from the acquired surface-effect selection table, and stores the density-value selection table in the storage unit 12. It is possible to store the surface-effect selection table in a storage server (cloud) on the network, such as the Internet, so that the control unit 15 can acquire the surface-effect selection table from the server and generate the density-value selection tale from the acquired surface-effect selection table. However, data of the surface-effect selection table stored in the DFE 50 needs to be the same as data of the surface-effect selection table stored in the storage unit 12.

Referring back to FIG. 6, the plane-data generating unit 122 sets a density value (a gloss control value) to a drawing object to which a predetermined surface effect is specified by a user, in accordance with the type of the specified surface effect by referring to the density-value selection table illustrated in FIG. 9. For example, it is assumed that the user specifies "PG" for a region represented by "ABC", specifies "G" for the rectangular region, and specifies "M" for the circular region in the target image being the color plane data illustrated in FIG. 2. In this case, the plane-data generating unit 122 sets "98%" to a density value of the drawing object ("ABC") for which the "PG" is specified by the user, sets "90%" to a density value of the drawing object ("the rectangle") for which the "G" is specified, and sets "16%" to a density value of the drawing object ("the circle") for which the "M" is specified, to thereby generate the gloss-control plane data. The gloss-control plane data generated by the plane-data generating unit 122 is data in a vector format, which is represented as aggregation of coordinates of points, parameters in equations on lines or planes connecting the points, and drawing objects indicating painted portions or special effects. FIG. 4 is a diagram illustrating an image of the gloss-control plane data. The plane-data generating unit 122 generates original data by integrating the gloss-control plane data, the image data of the target image (the color plane data), and the clear plane data, and sends the original data to the print-data generating unit 123.

Figure 11:
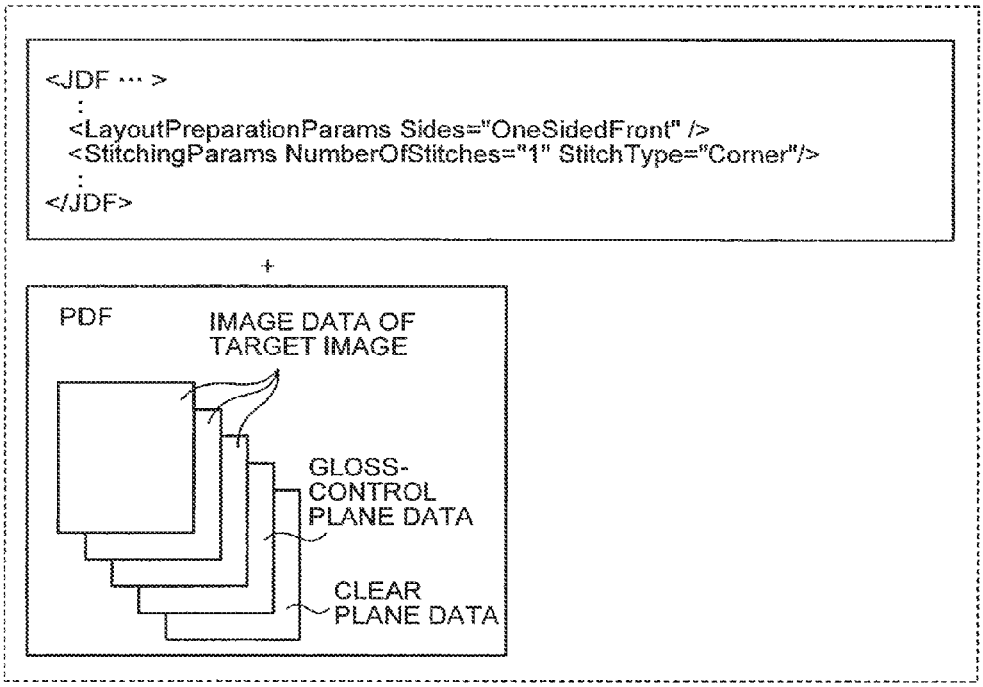
FIG. 11 is a diagram schematically illustrating a configuration example of print data.

The print-data generating unit 123 generates print data based on the original data. The print data contains the image data of the target image (the color plane data), the gloss-control plane data, the clear plane data, and a job command for specifying, for example, printer setting, aggregation setting, or duplex setting for the printer. FIG. 11 is a diagram schematically illustrating a configuration example of the print data. In the example of FIG. 11, Job Definition Format (JDF) is used as the job command; however, the present invention is not limited thereto. The JDF illustrated in FIG. 11 is a command for specifying "one-side printing and stapling" as the aggregation setting. The print data may be converted to page description language (PDL), such as PostScript, or may be maintained in the PDF format if the DFE 50 can handle the PDF format.

Figures 12, 13:
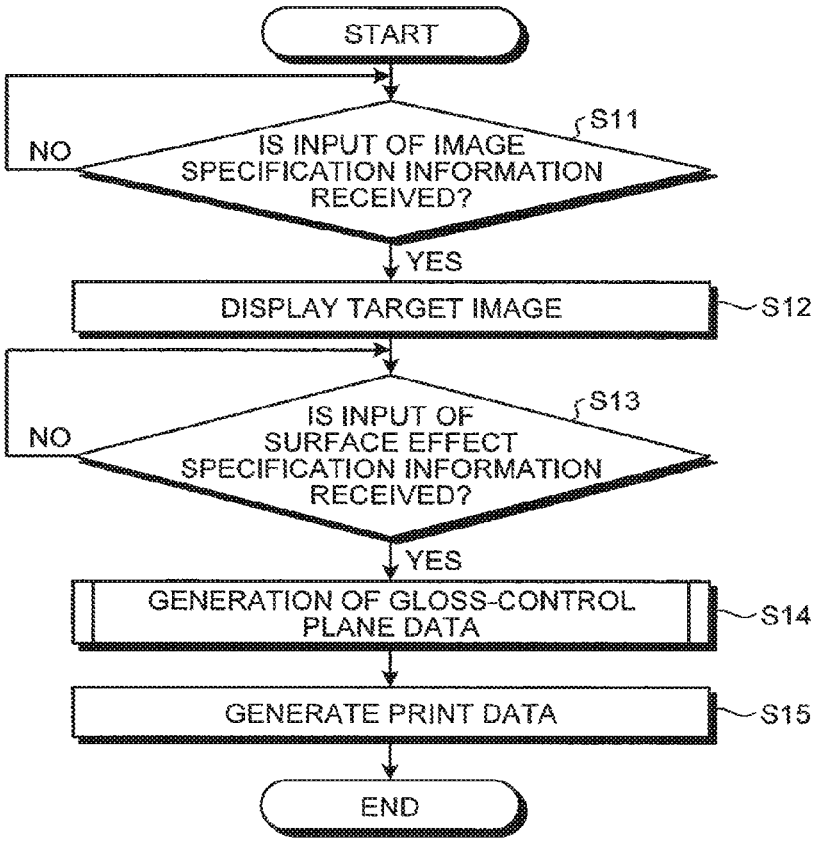
FIG. 12 is a flowchart of a procedure of a print-data generation process performed by the host device according to the first embodiment.
FIG. 13 is a diagram illustrating a correspondence relation of a drawing object, a coordinate, and a density value in the gloss-control plane data illustrated in FIG. 4.

A print-data generation process performed by the host device 10 configured as above will be explained below. FIG. 12 is a flowchart of a procedure of the print-data generation process performed by the host device 10 according to the first embodiment. In the following process example, a case will be explained in which a transparent image is not specified and thus, the clear plane data is not generated.

When the input control unit 124 receives input of image specification information (YES at Step S11), the display control unit 121 causes the display unit 14 to display an image specified by the received image specification information (Step S12). When the input control unit 124 receives input of surface-effect specification information (YES at Step S13), the plane-data generating unit 122 generates gloss-control plane data based on the received specification information (Step S14).

Specifically, the plane-data generating unit 122 identifies a drawing object, to which the surface effect is applied in the target image according to the specification information, and the coordinate of the drawing object, and determines a density value as a gloss control value corresponding to the surface effect that is applied in the specification information by the user, by referring to the density-value selection table stored in the storage unit 12. The plane-data generating unit 122 registers, in gloss-control plane data (which is initially blank data), the drawing object and the density value that is determined in accordance with the surface effect, in an associated manner. The plane-data generating unit 122 repeats the above processes on all of drawing objects contained in the target image. As a result, the gloss-control plane data illustrated in FIG. 4 is generated. FIG. 13 is a diagram illustrating a correspondence relation of the drawing object, the coordinate, and the density value in the gloss-control plane data illustrated in FIG. 4.

The plane-data generating unit 122 generates clear plane data based on a transparent image specified by a user via the application screen illustrated in FIG. 7 or FIG. 8.

After the gloss-control plane data is generated, the plane-data generating unit 122 generates original data by integrating the gloss-control plane data, the image data of the target image, and the clear plane data and sends the original data to the print-data generating unit 123. The print-data generating unit 123 generates print data based on the original data (Step S15). In this manner, the print data is generated.

Figure 14:
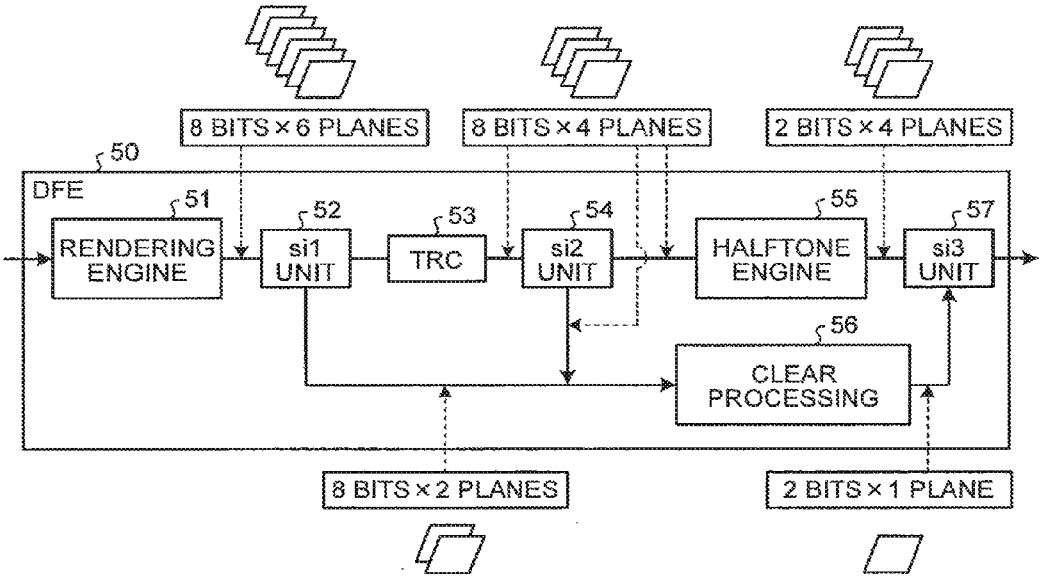
FIG. 14 is a diagram of a functional configuration example of a DFE.

A functional configuration of the DFE 50 will be explained below. As illustrated in FIG. 14 for example, the DFE 50 includes a rendering engine 51, an si1 unit 52, a Tone Reproduction Curve (TRC) 53, an si2 unit 54, a halftone engine 55, a clear processing 56, an si3 unit 57, and the surface-effect selection table (not illustrated). The rendering engine 51, the si1 unit 52, the TRC 53, the si2 unit 54, the halftone engine 55, the clear processing 56, and the si3 unit 57 are realized by causing a control unit of the DFE 50 to execute various programs stored in a main storage unit or an auxiliary storage unit. The si1 unit 52, the si2 unit 54, and the si3 unit 57 have functions of separating image data and integrating image data. The surface-effect selection table is stored in, for example, the auxiliary storage unit.

The rendering engine 51 receives input of the image data (for example, print data shown in FIG. 11) and the plane priority information sent from the host device 10. The rendering engine 51 interprets language of the input image data, converts the image data represented by the vector format to image data represented by the raster format, and converts a color space represented by an RGB format or the like to a color space represented by a CMYK format, thereby outputting color plane data of 8 bits each of CMYK (hereinafter, described as "8-bit CMYK image data"), clear plane data of 8 bits (hereinafter, described as "8-bit clear plane data"), and gloss control plane data of 8 bits (hereinafter, described as "8-bit gloss-control plane data"). The si1 unit 52 outputs each piece of the 8-bit CMYK image data to the TRC 53 and outputs the 8-bit gloss-control plane data and the 8-bit clear plane data to the clear processing 56. The DFE 50 converts the gloss-control plane data in the vector format output from the host device 10 to image data in the raster format. Therefore, the DFE 50 outputs the gloss-control plane data, in which the type of the surface effect, which is to be applied to the drawing object and which is specified by a user via the image processing application, is set as the density value for each pixel.

The TRC 53 receives the color plane data of 8 bits each of CMYK via the si1 unit 52. The TRC 53 performs gamma correction on the input image data by using a 1D_LUT based gamma curve generated by calibration. The image processing includes, for example, total toner amount control in addition to the gamma correction. The total amount control is a process of setting a limitation on each piece of the 8-bit CMYK image data obtained by the gamma correction, because the amount of toner that the printer 70 can attach to each of the pixels on a recording medium is limited. If printing is performed in excess of the total amount, the image quality is reduced due to a transfer failure or a fixing failure. In the present embodiment, only the related gamma correction will be explained.

The si2 unit 54 outputs the color plane data of 8 bits each of CMYK, which has been obtained by the gamma correction performed by the TRC 53, to the clear processing 56 as data used for generating an inverse mask (to be described below). The halftone engine 55 receives, via the si2 unit 54, the color plane data of 8 bits each of CMYK obtained by the gamma correction. The halftone engine 55 performs halftone processing for converting the data format of the input image data to obtain, for example, color plane data of 2 bits each of CMYK to be output to the printer 70, and thereafter outputs the image data, such as the color plane data 2 bits each of CMYK, obtained by the halftone processing. The 2-bit image data is described by way of example and the present invention is not limited thereto.

The clear processing 56 receives, via the si1 unit 52, the 8-bit gloss-control plane data that has been converted by the rendering engine 51 and also receives, via the si2 unit 54, the color plane data of 8 bits each of CMYK that has been obtained by the gamma correction performed by the TRC 53 and the clear plane data of 8 bits.

Figure 15:
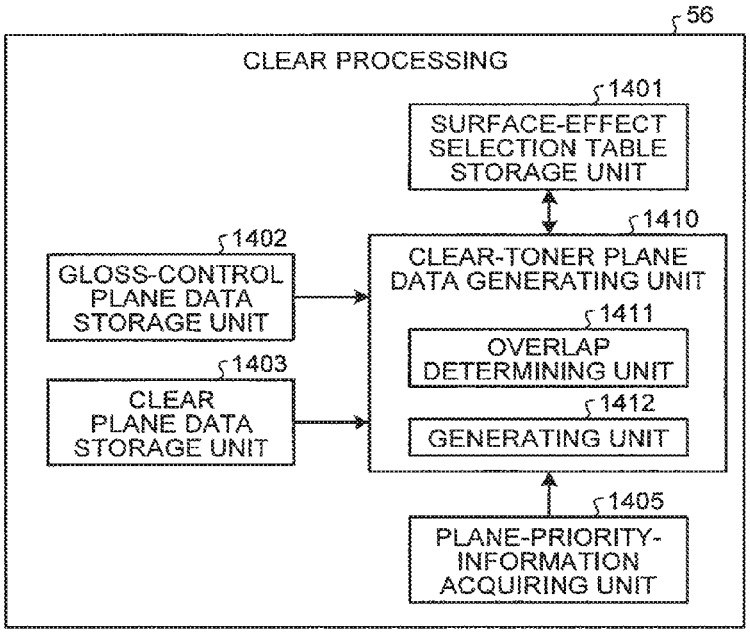
FIG. 15 is a block diagram of a functional configuration example of a clear processing.

FIG. 15 is a block diagram of a functional configuration of the clear processing 56. As illustrated in FIG. 15, the clear processing 56 mainly includes a surface-effect selection table storage unit 1401, a gloss-control plane data storage unit 1402, a clear plane data storage unit 1403, a plane priority-information acquiring unit 1405, and a clear-toner plane data generating unit 1410.

The gloss-control plane data storage unit 1402 is a storage medium for storing therein the input gloss-control plane data. The clear plane data storage unit 1403 is a storage medium for storing therein the input clear plane data. The surface-effect selection table storage unit 1401 is a storage medium for storing therein the surface-effect selection table to be described later.

The plane priority-information acquiring unit 1405 acquires the plane priority information via the si1 unit 52 and sends the plane priority information to the clear-toner plane data generating unit 1410.

The clear-toner plane data generating unit 1410 generates the clear-toner plane data. As illustrated in FIG. 15, the clear-toner plane data generating unit 1410 mainly includes an overlap determining unit 1411 and a generating unit 1412.

The overlap determining unit 1411 determines an overlapping area of a region where a density value (a gloss control value) is specified in the gloss-control plane data and a region where a density value is specified in the clear plane data, based on each piece of the plane data.

The generating unit 1412 generates clear-toner plane data based on the gloss-control plane data and the clear plane data. The generating unit 1412 determines a surface effect corresponding to the density value (the pixel value) of each pixel contained in the gloss-control plane data by referring to the surface-effect selection table stored in the surface-effect selection table storage unit 1401 by using the gloss-control plane data stored in the gloss-control plane data storage unit 1402, and determines on or off of the glosser 80 in accordance with the determination of the surface effect. Furthermore, the generating unit 1412 appropriately generates an inverse mask or a solid mask by using the input color plane data of 8 bits each of CMYK and appropriately generates clear-toner plane data of 2 bits for attaching a clear toner. Thereafter, the clear processing 56 appropriately generates clear-toner plane data used by the printer 70 and clear-toner plane data used by the low-temperature fixing device 90, and outputs the pieces of the plane data together with on-off information indicating on or off of the glosser 80.

The inverse mask is used for equalizing the total amount of the CMYK toners and the clear toner attached to each pixel contained in a target region to which the surface effect is to be applied. Specifically, image data, which is obtained by adding up all density values of pixels contained in the target region in the color plane data of CMYK and then subtracting the added-up value from a predetermined value, is used as the inverse mask. For example, an inverse mask 1 as described above can be represented by Equation (1) below.

$$Clr=100-(C+M+Y+K)$$

$$\text{where, when } Clr<0, Clr=0 \tag{1}$$

In Equation (1), Clr, C, M, Y, and K represent density ratios calculated from the density values in the pixels of the clear toner, C toner, M toner, Y toner, and K toner, respectively. That is, by Equation (1), the total amount of the attached toner obtained by adding an amount of the attached clear toner to a total amount of the attached toners of C, M, Y, and K is set as 100% for all the pixels contained in the target region to which the surface effects are to be applied. When the total amount of the attached toners C, M, Y, and K is equal to or greater than 100%, the clear toner is not to be attached and a density ratio of the clear toner is set to 0%. This is because a portion where the total amount of the attached toners of C, M, Y, and K exceeds 100% is to be smoothed by a fixing process. As described above, by setting the total amount of the attached toner on all the pixels contained in the target region to which the surface effect is to be applied to 100% or greater, it becomes possible to remove the surface irregularity caused by a difference in the total amount of the attached toners in the target region. As a result, gloss is obtained by specular reflection of light. The inverse mask may be calculated from an equation other than Equation (1), and there may be various types of the inverse masks.

For example, the inverse mask may be structured so that the clear toner is uniformly attached to each pixel. The inverse mask of this type is called a solid mask and represented by Equation (2) below.

$$Clr=100 \tag{2}$$

It is possible to set a density ratio other than 100% to some of the pixels in the target region to which the surface effect is to be applied. Therefore, there may be various patterns of the solid masks.

The inverse mask may be obtained by multiplication of background exposure ratios of the respective colors. The inverse mask of this type is represented by, for example, Equation (3) below.

$$Clr=100\times\{(100-C)/100\}\times\{(100-M)/100\}\times\{(100-Y)/100\}\times\{(100-K)/100\} \quad (3)$$

In Equation (3), (100−C)/100 represents a background exposure ratio of C, (100−M)/100 represents a background exposure ratio of M, (100−Y)/100 represents a background exposure ratio of Y, and (100−K)/100 represents a background exposure ratio of K.

The inverse mask may be obtained by using a method based on the assumption that a halftone dot having a maximum area ratio regulates the smoothness. The inverse mask of this type is represented by, for example, Equation (4) below.

$$Clr=100-\max(C,M,Y,K) \quad (4)$$

In Equation (4), max (C, M, Y, K) indicates that a density value of a color having the maximum density value among CMYK is used as a representative value.

Thus, any of the inverse masks represented by any of Equations (1) to (4) is applicable.

The surface-effect selection table is a table containing a correspondence relation of a density value being a gloss control value indicating a surface effect; a type of the surface effect; control information related to a post processing device corresponding to the configuration of the image forming system; clear-toner plane data used by the printer 70; and clear-toner plane data used by the post processing device. The image forming system can be configured in various ways; however, according to the present embodiment, the glosser 80 and the low-temperature fixing device 90 serving as the post processing devices are connected to the printer 70. Therefore, the control information related to the post processing device corresponding to the configuration of the image forming system is the on-off information indicating on or off of the glosser 80. Furthermore, the clear-toner plane data used by the post processing device includes clear-toner plane data used by the low-temperature fixing device 90. FIG. 16 is a diagram illustrating an exemplary data structure of the surface-effect selection table. The surface-effect selection table may be structured to indicate the correspondence relation of the control information related to the post processing device, clear-toner plane data 1 used by the printer 70, clear-toner plane data 2 used by the post processing device, the density value, and the type of the surface effect, in accordance with each of the configurations of different image forming systems. In FIG. 16, the data structure corresponding to the configuration of the image forming system according to the first embodiment is illustrated by way of example. In the correspondence relation between the type of the surface effect and the density value illustrated in the figure, each type of the surface effect is associated with a corresponding range of the density values. Furthermore, each type of the surface effect is associated with a corresponding percentage of the density (the density ratio), which is calculated from a value representing the range of the density value (i.e., the representative value), for every 2% change in the density ratio. More specifically, the surface effect for applying gloss (the specular effect and the solid effect) is associated with a range of the density values ("212" to "255") with the density ratios of 84% or greater, and the surface effect for suppressing gloss (the halftone-dot matt and the matt) is associated with a range of the density values ("1" to "43") with the density ratios of 16% or smaller. The surface effect, such as a texture or a background watermark, is associated with a range of the density values with the density ratios of 20% to 80%.

More specifically, the specular gloss (PM: Premium Gloss) as the surface effect is associated with the pixel values of "238" to "255" such that different types of specular gloss are associated with the following three respective ranges of pixel values: "238" to "242"; "243" to "247"; and "248" to "255". The solid gloss (G: Gloss) is associated with the pixel values of "212" to "232" such that different types of solid gloss are associated with the following four respective ranges of pixel values: "212" to "216"; "217" to "221"; "222" to "227"; and "228" to "232". The halftone-dot matt (M: Matt) is associated with pixel values of "23" to "43" such that different types of halftone-dot matt are associated with the following four respective ranges of pixel values: "23" to "28"; "29" to "33"; "34" to "38"; and "39" to "43". The matt (PM: Premium Matt) is associated with pixel values of "1" to "17" such that different types of matt are associated with the following three respective ranges of pixel values: "1" to "7"; "8" to "12"; and "13" to "17". The different types of the same surface effect are different from one another in terms of equations used for obtaining the clear-toner plane data used by the printer or the low-temperature fixing device, but the operations performed by the printer main body and the post processing devices are the same. Information indicating that no surface effect is to be applied is associated with the density value of "0".

In FIG. 16, the on-off information indicating on or off of the glosser 80, contents of the clear-toner plane data 1 (Clr-1 shown in FIG. 1) used by the printer 70, and contents of the clear-toner plane data 2 (Clr-2 shown in FIG. 1) used by the low-temperature fixing device 90 are also indicated in association with the pixel values and the surface effects. For example, when the surface effect is the specular gloss, it is indicated that the glosser 80 is to be on, the clear-toner plane data 1 used by the printer 70 is an inverse mask, and there is no data as the clear-toner plane data 2 used by the low-temperature fixing device 90. The inverse mask is obtained by, for example, Equation (1). The example illustrated in FIG. 16 is a case in which the specular effect is specified as the surface effect for the whole region defined by the image data. A case in which the specular effect is specified as the surface effect for a part of the whole region defined by the image data will be explained below.

When the density value is in the range of "228" to "232" and the solid gloss is specified as the surface effect, it is indicated that the glosser 80 is to be off, the inverse mask 1 is used as the clear-toner plane data 1 used by the printer 70, and there is no data as the clear-toner plane data 2 used by the low-temperature fixing device 90.

The inverse mask 1 can be any inverse mask represented by any of Equations (1) to (4). This is because, because the glosser 80 is off, the total amounts of the attached toners to be smoothed remain different and the surface irregularity increases due to the specular gloss, so that the solid gloss having the glossiness lower than that of the specular gloss can be obtained. When the surface effect is the halftone-dot matt, it is indicated that the glosser 80 is to be off, halftone (halftone dot) is used as the clear-toner plane data 1 used by the printer 70, and there is no data as the clear-toner plane data 2 used by the low-temperature fixing device 90. When the surface effect is the matt, it is indicated that the glosser 80 can be either on or off, there is no data as the clear-toner plane data 1 used by the printer 70, and a solid mask is used as the clear-toner plane data 2 used by the low-temperature fixing device 90. The solid mask is obtained by, for example, Equation (2).

Figure 17:
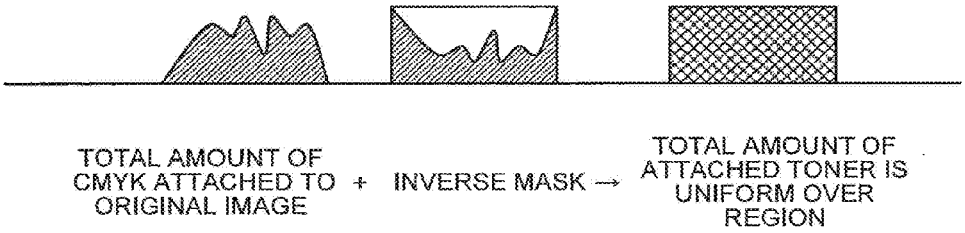
FIG. 17 is an explanatory diagram illustrating how to set a gloss effect on a color-toner original image.

FIG. 17 is an explanatory diagram illustrating how to set a gloss effect on a color-toner original image. The figure illustrates a variation in the density when an arbitrary portion of the image is scanned.

A total of the density values, i.e., C+M+Y+K, is calculated for each pixel of the 8-bit CMYK plane data. The calculated value is inverted as an inverse mask and is used as the amount of the clear toner to be attached. By superimposing the inverse mask on the original image, the total amount of the attached toners becomes uniform and a glossy region can be obtained.

Figure 18:
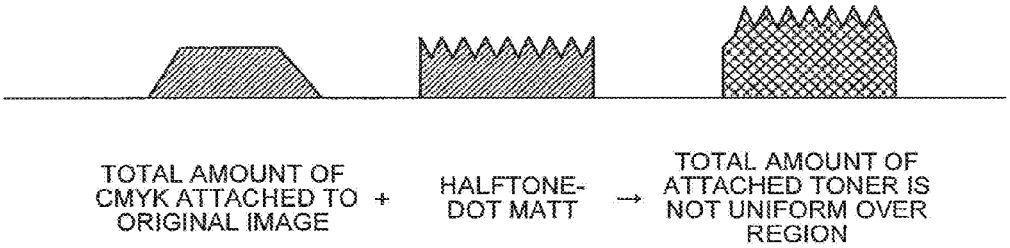
FIG. 18 is an explanatory diagram illustrating how to set a matt effect on color-toner image data.

FIG. 18 is an explanatory diagram illustrating how to set a matt effect on color-toner image data. In a glossy region where the CMYK toners are uniformly attached, if a halftone-dot matt with irregular densities as illustrated in the figure is superimposed by using the clear toner, the total amount of the attached toners that have been uniform becomes non-uniform. Therefore, the matt effect without gloss can be obtained. The halftone-dot matt is stored as pattern data in the DFE 50 and is applied to the region in units of pixels.

Figure 19:
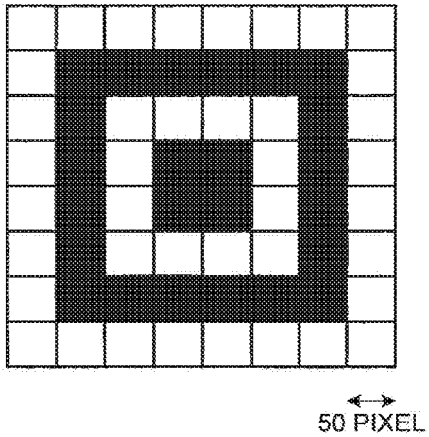
FIG. 19 is an explanatory diagram illustrating a background pattern effect.

FIG. 19 is an explanatory diagram illustrating a background pattern effect. In the figure, black and white cells are illustrated and one side of each cell is formed of a plurality of pixels, e.g., 50 pixels. The black cells are portions where the clear toner is attached and the white cells are portions where the clear toner is not attached. The pattern as shown in the figure is stored as data in the DFE 50 and is applied to the region in units of pixels.

The clear processing 56 determines the surface effect associated with each pixel value indicated in the gloss-control plane data by referring to the above surface-effect selection table, determines on or off of the glosser 80, and determines clear-toner plane data used by each of the printer 70 and the low-temperature fixing device 90. The clear processing 56 determines on or off of the glosser 80 for every one page. The clear processing 56 appropriately generates the clear-toner plane data as described above in accordance with the result of the determination, outputs the image data, and outputs the on-off information on the glosser 80.

When the generating unit 1412 generates the clear-toner plane data, if the overlap determining unit 1411 determines that there is an overlapping area of a region where the density value (the gloss control value) is specified in the gloss-control plane data and a region where the density value is specified in the clear plane data, the generating unit 1412 sets the clear-toner plane data of the overlapping area so as to have either the density value specified in the gloss-control plane data or the density value specified in the clear plane data, based on the plane priority information that is used as a predetermined condition.

Specifically, when the plane priority information indicates that priority is given to the gloss-control plane data, the generating unit 1412 generates the clear-toner plane data by setting, as a value of the overlapping area, the density value (the gloss control value) specified in the overlapping area of the gloss-control plane data. When the plane priority information indicates that priority is given to the clear plane data, the generating unit 1412 generates the clear-toner plane data by setting, as a value of the overlapping area, the density value specified in the overlapping area of the clear plane data.

The case that priority is given to the clear plane data means that a watermark is prioritized; therefore, the specification of the watermark is prioritized over the specification of the surface effect in the gloss-control plane data. The case that priority is given to the gloss-control plane data means that any surface effect is prioritized in even a region containing a watermark if any surface effect is specified in the gloss-control plane data.

FIG. 20 is a diagram for explaining pixel data of the overlapping area generated in accordance with the plane priority information. As illustrated in FIG. 20, when both clear plane pixel data and gloss-control plane pixel data are not zero, and if the plane priority information indicates that priority is given to the gloss-control plane data, the generating unit 1412 sets clear-toner plane pixel data to the gloss-control plane pixel data according to the priority. On the other hand, if the plane priority information indicates that priority is given to the clear plane data, the generating unit 1412 sets the clear-toner plane pixel data to the clear plane pixel data according to the priority. When one of the clear plane pixel data and the gloss-control plane pixel data is zero as illustrated in FIG. 20, the generating unit 1412 sets the clear-toner plane pixel data to the pixel data that is not zero. Details are explained below.

FIG. 21 is a diagram illustrating examples of the value of the clear plane data for each pixel, the value of the gloss-control plane data, and the value of the clear-toner plane data generated based on the clear plane data and the gloss-control plane data when the plane priority information indicates that priority is given to the clear plane data. The value of the clear plane data is either 0 or 255 in each pixel.

When the value of the clear plane data is zero, the generating unit 1412 uses the value of gloss-control plane data as the value of the clear-toner plane data. When the gloss-control pixel value is zero, that is, when there is no control, the generating unit 1412 sets the value of the clear-toner plane data to the value of the clear plane data as it is. When both of the value of the clear plane data and the value of the gloss-control plane data are other than zero, because priority is given to the clear plane data, the generating unit 1412 sets the value of the clear-toner plane data to the value of the clear plane data, i.e., 255.

When gloss (specular gloss or solid gloss) is specified as the surface effect, the same result as a watermark is obtained. Therefore, the value of the clear plane data of 255 is shown in FIG. 21.

FIG. 22 is a diagram illustrating examples of the value of the clear plane data, the value of the gloss-control plane data, and the value of the clear-toner plane data generated based on the clear plane data and the gloss-control plane data when the plane priority information indicates that priority is given to the gloss-control plane data. When both of the value of the clear plane data and the value of the gloss-control plane data are other than zero, because priority is given to the gloss-control plane data, the generating unit 1412 sets the value of the clear-toner plane data to the value of the gloss-control plane data.

When gloss (specular gloss or solid gloss) is specified as the surface effect, similarly to the case that priority is given to the clear plane data, the same result as a watermark is obtained. Therefore, the value of the clear plane data of 255 is shown in FIG. 22.

Referring back to the FIG. 14, the si3 unit 57 integrates the color plane data of 2 bits each of CMYK obtained by the halftone processing and the 2-bit clear-toner plane data generated by the clear processing 56, and outputs the integrated image data to the MIC 60. In some cases, the clear processing 56 does not generate at least one of the clear-toner plane data used by the printer 70 and the clear-toner plane data used by the low-temperature fixing device 90. In this case, the si3 unit 57 integrates the clear-toner plane data generated by the clear processing 56. If the clear processing 56 does not generate both pieces of the clear-toner plane data, the si3 unit 57 outputs image data obtained by integrating the color plane data of 2 bits each of CMYK. As a result, the DFE 50 sends four to six pieces of 2-bit image data to the MIC 60. The si3 unit 57 also outputs the on-off information on the glosser 80, which has been output by the clear processing 56, to the MIC 60.

Figure 23:
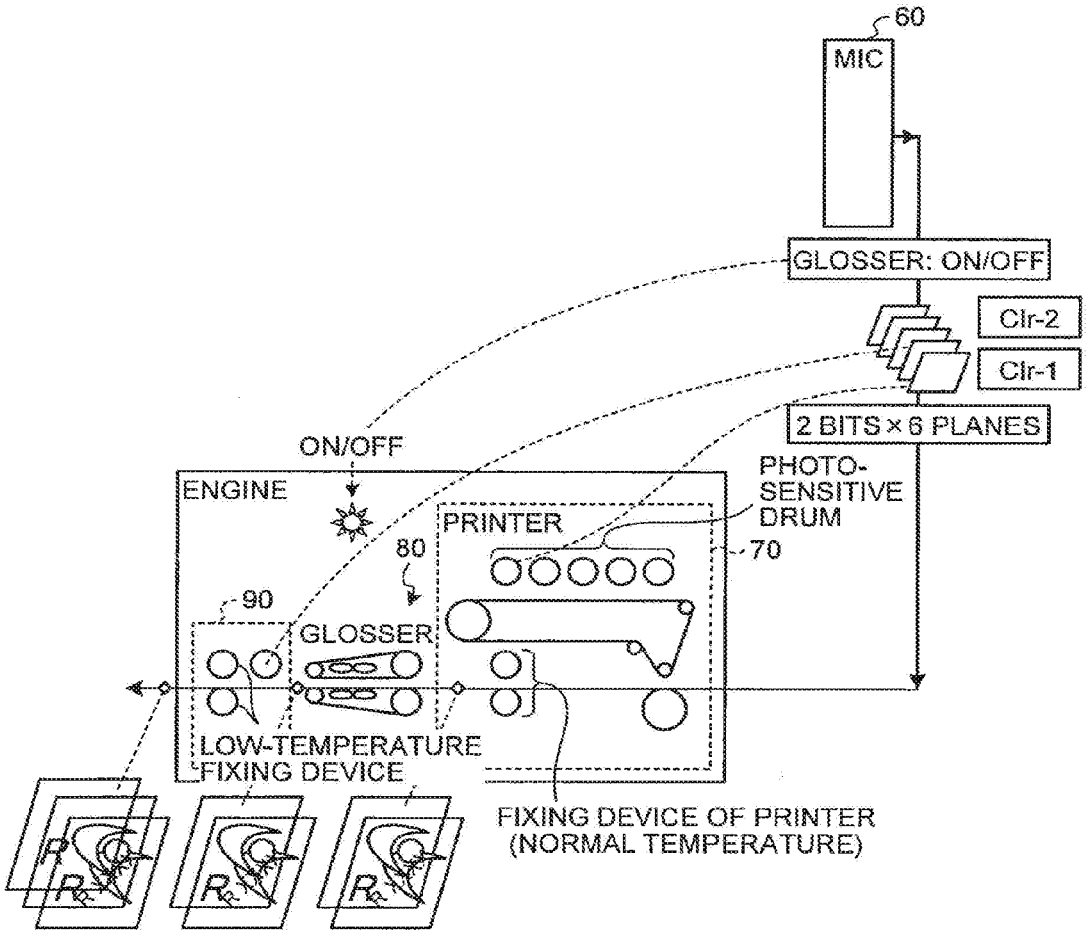
FIG. 23 is a diagram schematically illustrating a configuration example of an MIC.

The MIC outputs apparatus configuration information indicating an apparatus configuration of the post-processing devices to the DEF 50. The MIC 60 is connected to the DFE 50 and the printer 70, receives the color plane data and the clear-toner plane data from the DFE 50, distributes the received pieces of plane data to corresponding devices, and controls the post processing devices. More specifically, as illustrated in FIG. 23, the MIC 60 outputs the plane data each of CMYK to the printer 70 from among the pieces of the plane data output from the DFE 50, also outputs the clear-toner plane data used by the printer 70 to the printer 70 when this plane data is present, turns on or off the glosser 80 by using the on-off information output form the DFE 50, and outputs the clear-toner plane data used by the low-temperature fixing device 90 to the low-temperature fixing device 90 when this plane data is present. The glosser 80 may switch between a pathway in which the fixing operation is performed and a pathway in which the fixing operation is not performed, depending on the on-off information. The low-temperature fixing device 90 may switch on and off in accordance with the presence or absence of the clear-toner plane data or may switch between the pathways similarly to the glosser 80.

As shown in FIG. 23, the printing apparatus including the printer 70, the glosser 80, and the low-temperature fixing device 90 further includes a conveying path for conveying a recording medium. The printer 70 specifically includes a plurality of photosensitive drums of an electrophotographic system, a transfer belt onto which toner images formed on the photosensitive drums are transferred, a transfer device that transfers the toner images on the transfer belt onto a recording medium, and a fixing device that fixes the toner images, which are transferred onto the recording medium, on the recording medium. The recording medium is conveyed on the conveying path by not-shown conveying members to be conveyed through, in the written order, positions where the printer 70, the glosser 80, and the low-temperature fixing device 90 are provided. After the recording medium is subjected to the processes by these devices, an image is formed on the recording medium, and surface effects are applied to the recording medium, the recording medium is conveyed on the conveying path by a not-shown conveying mechanism and discharged to the outside of the printing apparatus.

Figure 24:
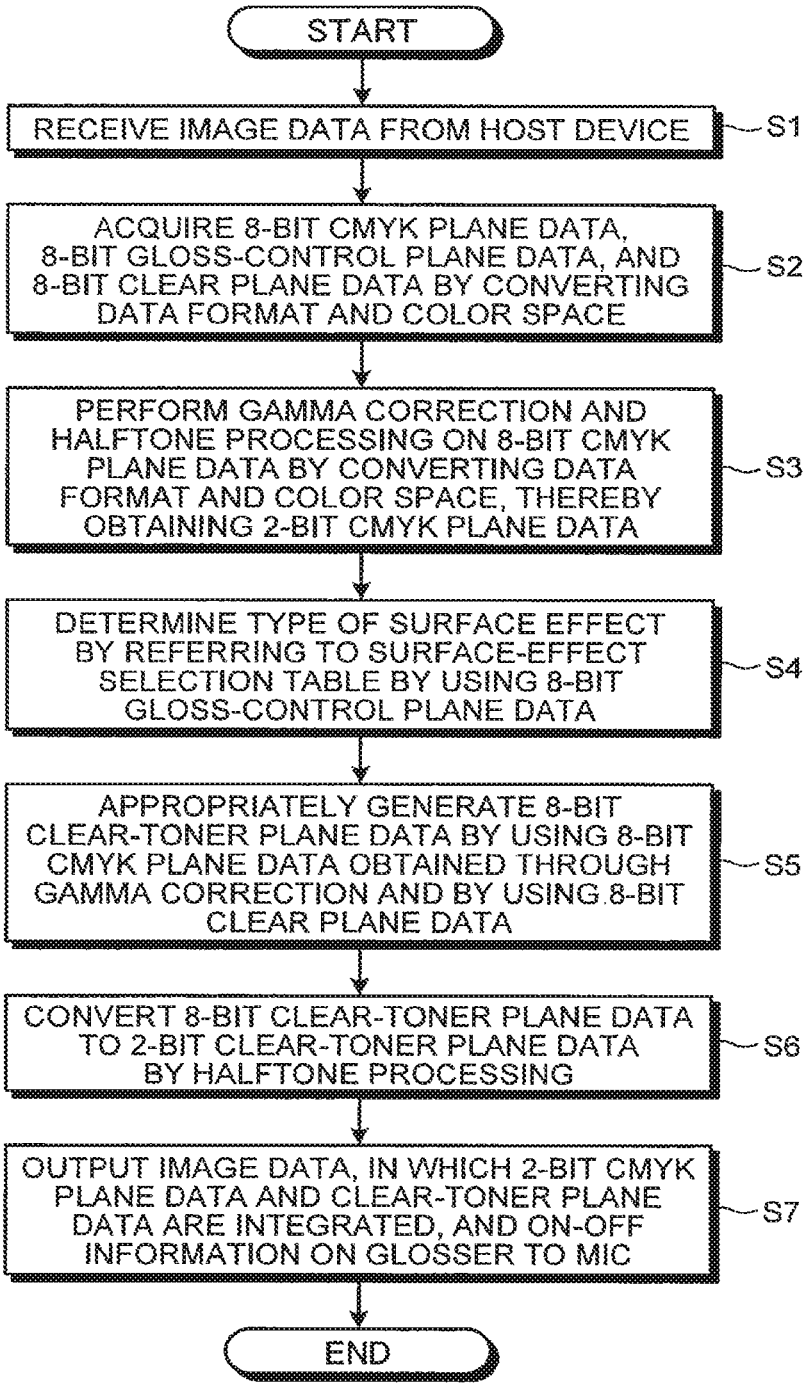
FIG. 24 is a flowchart of a procedure of a gloss control process performed by the image forming system.

A gloss control process performed by the image forming system according to the present embodiment will be explained below with reference to FIG. 24. When the DFE 50 receives image data from the host device 10 (Step S1), the rendering engine 51 interprets language of the image data, converts the image data represented by the vector format to image data represented by the raster format, and converts a color space represented by the RGB format to a color space represented by the CMYK format, so that the color plane data of 8 bits each of CMYK, the gloss-control plane data of 8 bits, and the clear plane data of 8 bits are obtained (Step S2).

In the process of converting the gloss-control plane data, the gloss-control plane data as illustrated in FIG. 4, i.e., the gloss-control plane data in which the density value for identifying the surface effect is designated for each drawing object as illustrated in FIG. 13, is converted to gloss-control plane data in which the density value is designated for each pixel of each drawing object.

Subsequently, when the 8-bit gloss-control plane data is output, the TRC 53 of the DFE 50 performs gamma correction on the color plane data of 8 bits each of CMYK by using a 1D_LUT-based gamma curve generated by calibration. The halftone engine 55 performs halftone processing on the color plane data obtained by the gamma correction in order to convert the color plan data into image data of 2 bits each of CMYK to be output to the printer 70, whereby the image data of 2 bits each of CMYK after the halftone processing are obtained (Step S3).

The clear processing 56 of the DFE 50 determines the type of a surface effect that is specified for each pixel value indicated in the gloss-control plane data, by referring to the surface-effect selection table by using the 8-bit gloss-control plane data. The clear processing 56 performs the above determination on all of the pixels contained in the gloss-control plane data. In the gloss-control plane data, all pixels contained in a region to which the same surface effect is applied basically have the density values in the same range. Therefore, the clear processing 56 determines that pixels near the pixels that are determined to have the same surface effect are contained in the region to which the same surface effect is applied. In this manner, the clear processing 56 identifies the region to which the surface effect is applied and the type of the surface effect to be applied to the region. The clear processing 56 determines on or off of the glosser 80 in accordance with the determination (Step S4).

Then, the clear processing 56 of the DFE 50 appropriately generates 8-bit clear-toner plane data for attaching the clear toner by appropriately using the color plane data of 8 bits each of CMYK obtained through the gamma correction and the 8-bit clear plane data (Step S5). The halftone engine 55 converts the 8-bit clear-toner plane data based on the 8-bit image data to 2-bit clear-toner plane data through the halftone processing (Step S6).

The si3 unit 57 of the DFE 50 integrates the color plane data of 2 bits each of CMYK obtained through the halftone processing at Step S3 and the 2-bit clear-toner plane data generated at Step S6, and outputs the integrated plane data and the on-off information indicating on or off of the glosser 80 determined at Step S4 to the MIC 60 (Step S7).

At Step S5, when the clear processing 56 does not generate the clear-toner plane data, only the color plane data of 2 bits each of CMYK obtained through the halftone processing at Step S3 are integrated and the integrated plane data is output to the MIC 60 at Step S7.

Figure 25:
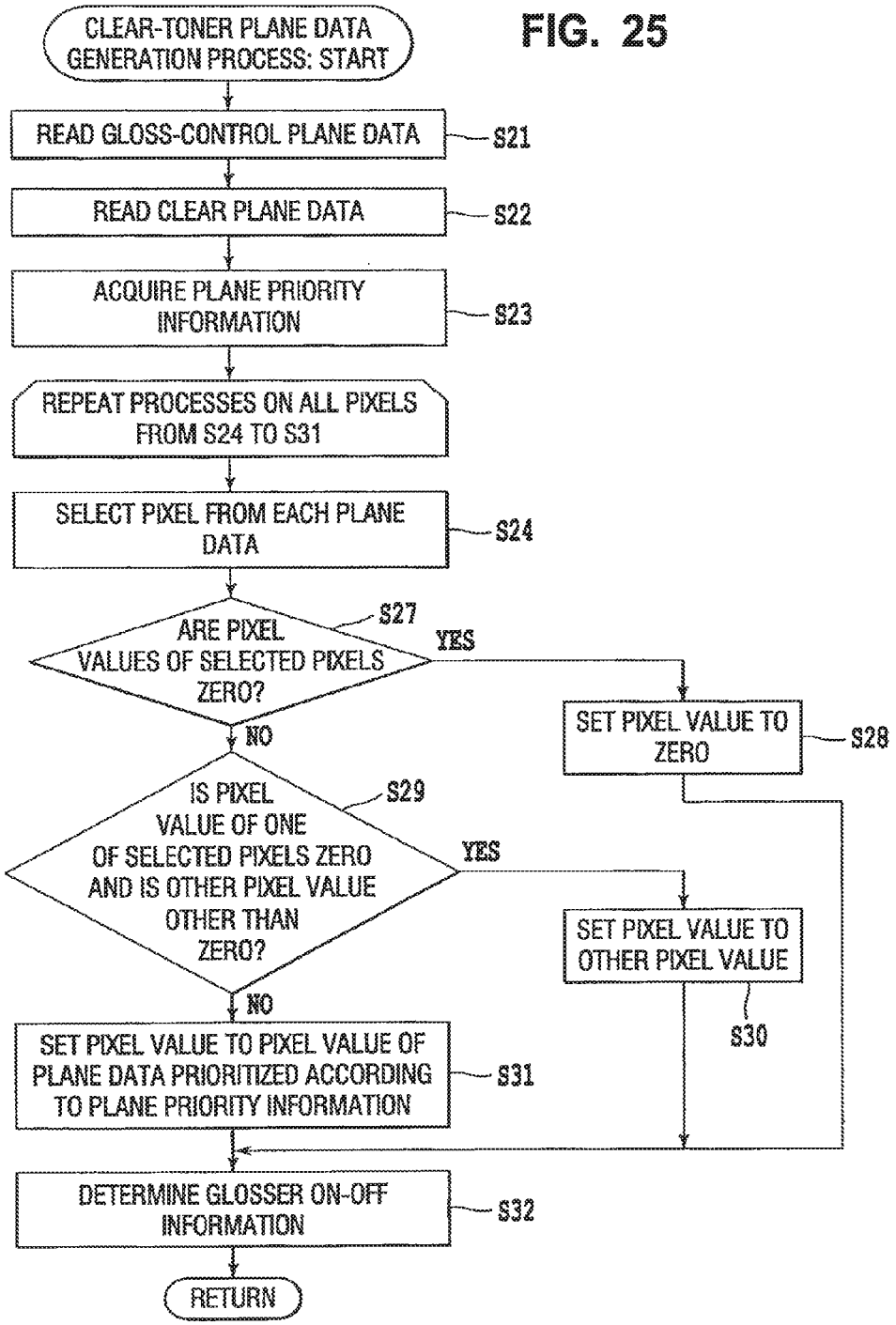
FIG. 25 is a flowchart of a procedure of a clear-toner plane data generation process according to the first embodiment.

A clear-toner plane data generation process at Step S5 will be explained below. FIG. 25 is a flowchart of a procedure of the clear-toner plane data generation process according to the first embodiment.

The overlap determining unit 1411 of the clear-toner plane data generating unit 1410 reads the gloss-control plane data from the gloss-control plane data storage unit 1402 (Step S21), and reads the clear plane data from the clear plane data storage unit 1403 (Step S22). The generating unit 1412 of the clear-toner plane data generating unit 1410 acquires the plane priority information from the plane priority-information acquiring unit 1405 (Step S23).

The overlap determining unit 1411 selects a pixel from each plane data, i.e., a pixel from the gloss-control plane data and a pixel from the clear plane data (Step S24). The overlap determining unit 1411 determines whether the selected pixels are in the overlapping area of a region where the density value (the gloss control value) is specified in the gloss-control plane data and a region where the density value is specified in the clear plane data, based on the pixel values of the selected pixels. The determination is performed in the following manner.

The overlap determining unit 1411 determines whether both of the pixel values of the selected pixels are zero (Step S27). When both of the pixel values of the selected pixels are zero (YES at Step S27), the generating unit 1412 sets a pixel value of a pixel of the clear-toner plane data corresponding to the pixels selected at Step S24 to zero (Step S28).

On the other hand, when both of the pixel values of the selected pixels are not zero (NO at Step S27), the overlap determining unit 1411 determines whether one of the pixel values of the selected pixels is zero and the other of the pixel values of the selected pixels is other than zero (Step S29).

When one of the pixel values of the selected pixels is zero and the other of the pixel values of the selected pixels is other than zero (YES at Step S29), the generating unit 1412 sets the pixel value of a corresponding pixel of the clear-toner plane data to the other pixel value (i.e., the pixel value other than zero) (Step S30).

On the other hand, at Step S29, when it is not the case that one of the pixel values of the selected pixels is zero and the other of the pixels values of the selected pixels is other than zero (NO at Step S29), it is determined that the selected pixels are in the overlapping area, and the generating unit 1412 sets the pixel value of a corresponding pixel of the clear-toner plane data to the pixel value of the plane data that is prioritized in accordance with the plane priority information to (Step S31).

Then, the clear processing 56 determines on or off of the glosser 80 based on the plane data prioritized in accordance with the plane priority information (Step S32). For example, when the watermark and specular gloss region overlap each other and the priority is given to the clear plane data, because the water mark region is prioritized, the clear processing 56 determines that the glosser is to be off.

The processes from Step S24 to Step S31 are repeated on all of the pixels in the gloss-control plane data and the clear plane data. Consequently, the clear-toner plane data is generated, in which the pixel values of the plane data specified in the plane priority information are set for the overlapping area.

Figure 26:
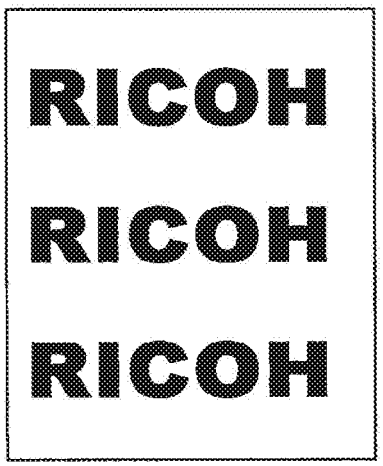
FIG. 26 is a diagram illustrating an example of a transparent image, i.e., a watermark image, generated by the image processing application of the host device.

A concrete example will be explained below. FIG. 26 is a diagram illustrating an example of a transparent image, i.e., a watermark image, generated by the image processing application of the host device 10. In FIG. 26, the image is colored in black but actually the image is transparent and glossy.

Figure 27:
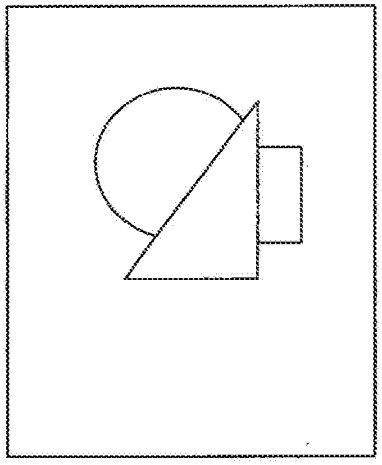
FIG. 27 is a diagram illustrating an example of color plane data generated by the image processing application of the host device.

FIG. 27 is a diagram illustrating an example of color plane data generated by the image processing application of the host device 10. In FIG. 27, only frames of graphics are illustrated but actually the graphics have colors represented by CMYK.

Figure 28:
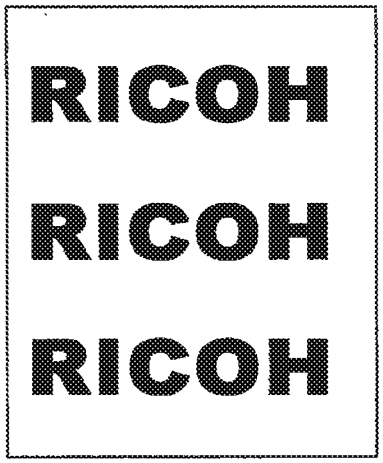
FIG. 28 is a diagram illustrating clear plane data corresponding to the watermark illustrated in FIG. 26.
Figure 29:
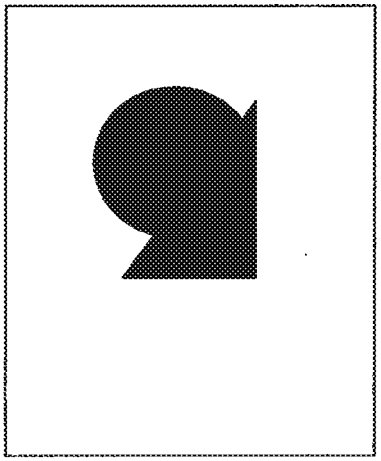
FIG. 29 is a diagram illustrating an example of gloss-control plane data, in which a region where a matt effect as a surface effect is applied is specified based on the color plane data illustrated in FIG. 27.

FIG. 28 is a diagram illustrating clear plane data corresponding to the watermark illustrated in FIG. 26. FIG. 29 is a diagram illustrating an example of gloss-control plane data, in which a region where a matt effect as the surface effect is to be applied is specified based on the color plane data illustrated in FIG. 27. In the example in FIG. 29, the matt effect is to be applied in an area smaller than the region illustrated in FIG. 27.

Figure 30:
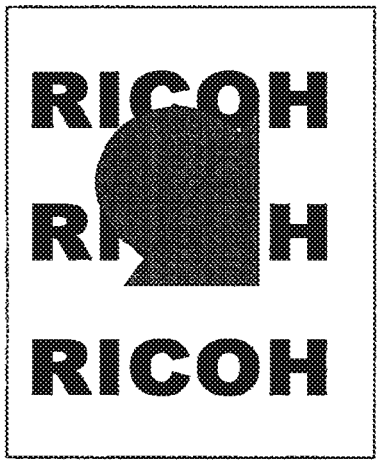
FIG. 30 is a diagram illustrating an example of clear-toner plane data.

In this example, if the plane priority information indicates that priority is given to the gloss-control plane data, the generating unit 1412 generates the clear-toner plane data as illustrated in FIG. 30. In FIG. 30, black portions are portions where the clear toner is uniformly attached and shaded portions are portions where the clear toner is attached using a pattern for imparting the matt effect to the color image.

Figure 31:
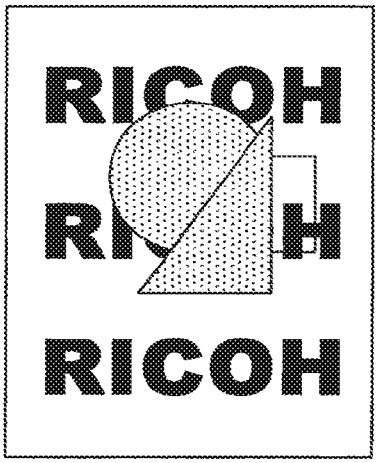
FIG. 31 is a diagram illustrating a final image obtained from the clear-toner plane data illustrated in FIG. 30.

FIG. 31 is a diagram illustrating a final image obtained from the clear-toner plane data illustrated in FIG. 30. As illustrated in FIG. 30, images of a corporate logo are transparent and glossy and therefore visible, but portions of the corporate logo overlapping the color image are missing as illustrated in FIG. 31.

Figure 32:
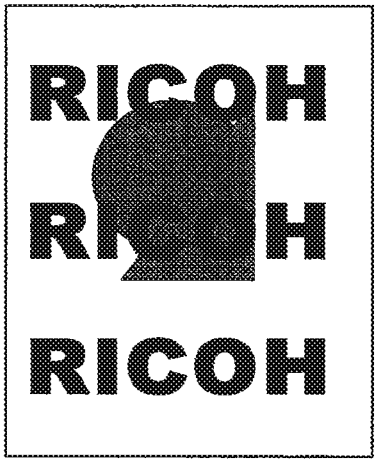
FIG. 32 is a diagram illustrating an example of clear-toner plane data.
Figure 33:
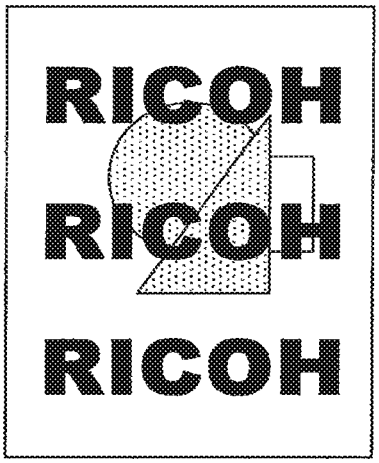
FIG. 33 is a diagram illustrating a final image obtained from the clear-toner plane data illustrated in FIG. 32.

On the other hand, when the plane priority information indicates that priority is given to the clear plane data, the generating unit 1412 generates the clear-toner plane data as illustrated in FIG. 32. FIG. 33 is a diagram illustrating a final image obtained from the clear-toner plane data illustrated in FIG. 32. As illustrated in FIG. 33, images of the corporate logo are entirely printed without any missing portion. On the other hand, a part of the region to which the matt is applied is missing.

As described above, according to the first embodiment, the plane priority information indicating whether priority is given to the gloss-control plane data or the clear plane data is acquired, and one of the pieces of the plane data is selected and reflected in pixels of the clear-toner plane data in the overlapping area, in which regions specified in the gloss-control plane data and the clear plane data overlap each other, in accordance with the plane priority information. Therefore, in the first embodiment, when priority is uniformly given to either the watermark or the surface effect, such as matt, in the overlapping area, it becomes possible to obtain a desired image by only uniformly specifying the priority of the image data without specifying the priority of each of the overlapping areas one-by-one. As a result, it is possible to improve the convenience of users.

Second Embodiment

In the first embodiment, the clear-toner plane data is set to have a pixel value of either the clear plane data or the gloss-control plane data, based on the plane priority information indicating whether priority is given to the clear plane data or the gloss-control plane data, with respect to the overlapping area in which a region where the transparent image, such as a watermark, is specified in the clear plane data and a region where the surface effect is specified in the gloss-control plane data overlap each other. In the second embodiment, a plurality of patterns indicating different priority orders of a plurality of types of the surface effects and the transparent image are registered as the plane priority information; a priority order specified by a user is acquired as the plane priority information; and the clear-toner plane data is set to have a pixel value of either the clear plane data or the gloss-control plane data.

In the host device 10 of the present embodiment, the display control unit 121 displays a screen for setting the plane priority information to allow a user to select a priority order A, a priority order B, a priority order C, or a priority order D as the plane priority information, instead of displaying the screen for setting the plane priority information as illustrated in FIG. 9, so that one of the priority orders A, B, C, and D is selected by the user. The I/F unit 11 of the host device 10 sends the selected priority order as the plane priority information to the DFE 50. The functions and the configurations of the host device 10 except for the display control unit 121 and the I/F unit 11 are the same as those of the first embodiment.

FIG. 34 is an explanatory diagram illustrating details of the plane priority information according to the second embodiment. As illustrated in FIG. 34, there are the following four types of the plane priority information of the present embodiment: the priority order A; the priority order B; the priority order C; and the priority order D. The "priority order A" indicates that, when matt and the clear plane data, such as a watermark, are designated in an overlapping manner, the matt is employed, and, when a background pattern and a watermark overlap each other, the watermark is employed.

The "priority order B" indicates that, when matt and the clear plane data, such as a watermark, are designated in an overlapping manner, the watermark is employed, and, when a background pattern and a watermark overlap each other, the background pattern is employed.

The "priority order C" indicates that the priority order of each surface effect is the same with respect to the clear plane data, such as a watermark, and the gloss-control plane data is prioritized similarly to the case that priority is given to the gloss-control plane data in the plane priority information of the first embodiment.

The "priority order D" indicates that the priority order of each surface effect is the same with respect to the clear plane data, such as a watermark, and the clear plane data is prioritized similarly to the case that priority is given to the clear plane data in the plane priority information of the first embodiment.

The plane priority information as described above with reference to FIG. 34 is stored in a storage medium, such as a memory of the DFE 50 or an HDD, in advance. In an example of FIG. 34, the matt and the background pattern are employed as the surface effects. Alternatively, the specular gloss and/or solid gloss also may be employed.

The generating unit 1412 of the clear processing 56 of the DFE 50 selects a priority order corresponding to the priority order indicated by the plane priority information sent by the host device 10, and determines a pixel value of the clear-toner plane data corresponding to a pixel whose pixel value in each of the clear plane data and the gloss-control plane data is other than zero, in accordance with the priority order contained in the plane priority information.

FIG. 35 is a diagram illustrating a concrete example of settings when the plane priority information indicates the "priority order A". When the clear pixel value is 255 and the gloss-control pixel value is 2 (matt) in the overlapping area in which regions specified in the clear plane data and the gloss-control plane data overlap each other, the generating unit 1412 employs the matt according to the order in the priority order A, and sets a value of the clear-toner plane data to the value of the gloss-control plane data. When the clear pixel value is 255 and the gloss-control pixel value is 3 (background pattern) in the overlapping area, the generating unit 1412 employs the value of the clear plane data according to the order in the priority order A, and sets the value of the clear-toner plane data to the value of the clear plane data.

The functions and the configurations of the DFE 50 except for the generating unit 1412 of the clear processing 56 are the same as those of the first embodiment.

Figure 36:
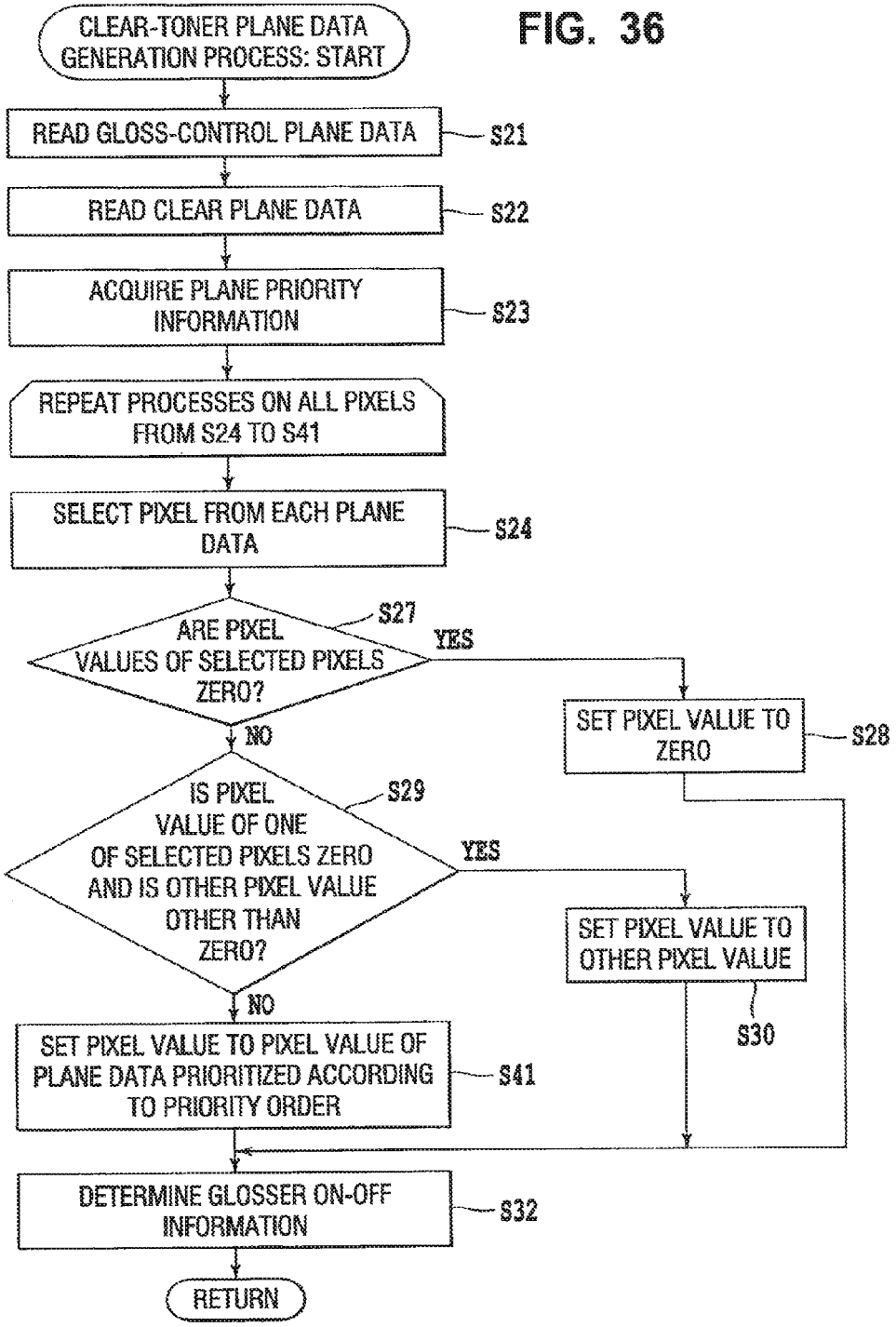
FIG. 36 is a flowchart of a procedure of a clear-toner plane data generation process according to the second embodiment.

A clear-toner plane data generation process of the present embodiment with the above configuration will be explained below. FIG. 36 is a flowchart of a procedure of the clear-toner plane data generation process according to the second embodiment.

The processes from Step S21 to Step S29 and Step S30 are the same as those of the first embodiment. In the present embodiment, when it is not the case that one of the pixel values of the selected pixels is zero and the other of the pixel values of the selected pixels is other than zero at Step S29 (NO at Step S29), it is determined that the selected pixels are in the overlapping area, and the generating unit 1412 sets a pixel value of a corresponding pixel of the clear-toner plane data to the pixel value of the plane data that is prioritized according to the priority order specified in the plane priority information (Step S41). Then, as in the first embodiment, the clear processing 56 determines on or off of the glosser 80 based on the plane data prioritized in accordance with the plane priority information (Step S32).

The processes from Step S21 to Step S41 are repeated on all of the pixels in the gloss-control plane data and the clear plane data. Consequently, the clear-toner plane data is generated, in which the pixel values of the plane data specified according to the priority order in the plane priority information are set for the overlapping area.

As described above, according to the second embodiment, the priority order of each of the surface effects in the gloss-control plane data is specified, and the clear-toner plane data is generated, whose pixel value is set to the pixel value of the plane data prioritized according to the priority order in the overlapping area. Therefore, it is possible to obtain an image, in which the priority order of each of the surface effects in the gloss-control plane data is more precisely reflected compared with the case that the plane priority information is uniformly specified. As a result, it is possible to improve the convenience of users.

Third Embodiment

In the first embodiment, the clear-toner plane data is set to have a pixel value of either the clear plane data or the gloss-control plane data, based on the plane priority information indicating whether priority is given to the clear plane data or the gloss-control plane data, with respect to the overlapping area in which a region where the transparent image, such as a watermark, is specified in the clear plane data and a region where the surface effect is specified in the gloss-control plane data overlap each other. In the third embodiment, a user is allowed to specify whether to give priority to the clear plane data or the gloss-control plane data for each region, and a pixel value of the clear-toner plane data is set to a pixel value of the plane data that is specified in the plane priority information for each region in the overlapping area.

Figures 37, 38:
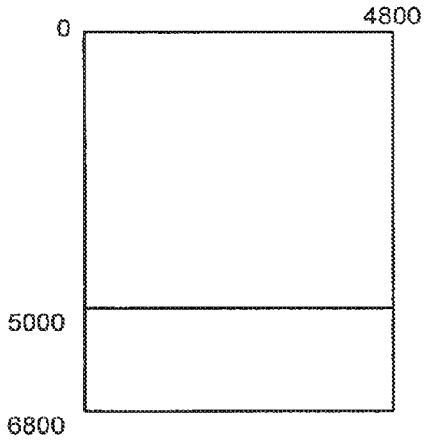
FIG. 37 is a diagram illustrating an example of the coordinates of regions to be specified.
FIG. 38 is an explanatory diagram illustrating details of plane priority information according to a third embodiment.

In the host device 10 of the present embodiment, the display control unit 121 displays a screen for allowing a user to specify the coordinate of a region where the clear plane data is prioritized and the coordinate of a region where the gloss-control plane data is prioritized, in addition to the screen for setting the plane priority information as illustrated in FIG. 9. FIG. 37 is a diagram illustrating an example of the coordinates of regions to be specified. As illustrated in FIG. 37, a region is specified by using the coordinate with the origin at the upper left corner.

The I/F unit 11 of the host device 10 sends the plane priority information for each region specified by the coordinate to the DFE 50. The functions and the configurations of the host device 10 except for the display control unit 121 and the I/F unit 11 are the same as those of the first embodiment.

FIG. 38 is an explanatory diagram illustrating details of the plane priority information according to the third embodiment. As illustrated in FIG. 38, in the plane priority information of the present embodiment, whether priority is given to the gloss-control plane data or the clear plane data is registered for each region in accordance with the instruction of the user.

The generating unit 1412 of the clear processing 56 of the DFE 50 of the present embodiment sets a pixel value of the clear-toner plane data in the overlapping area to a pixel value of the plane data, which is specified for each region in the plane priority information so as to generate the clear-toner plane data.

The functions and the configurations of the DFE 50 except for the generating unit 1412 of the clear processing 56 are the same as those of the first embodiment.

Figure 39:
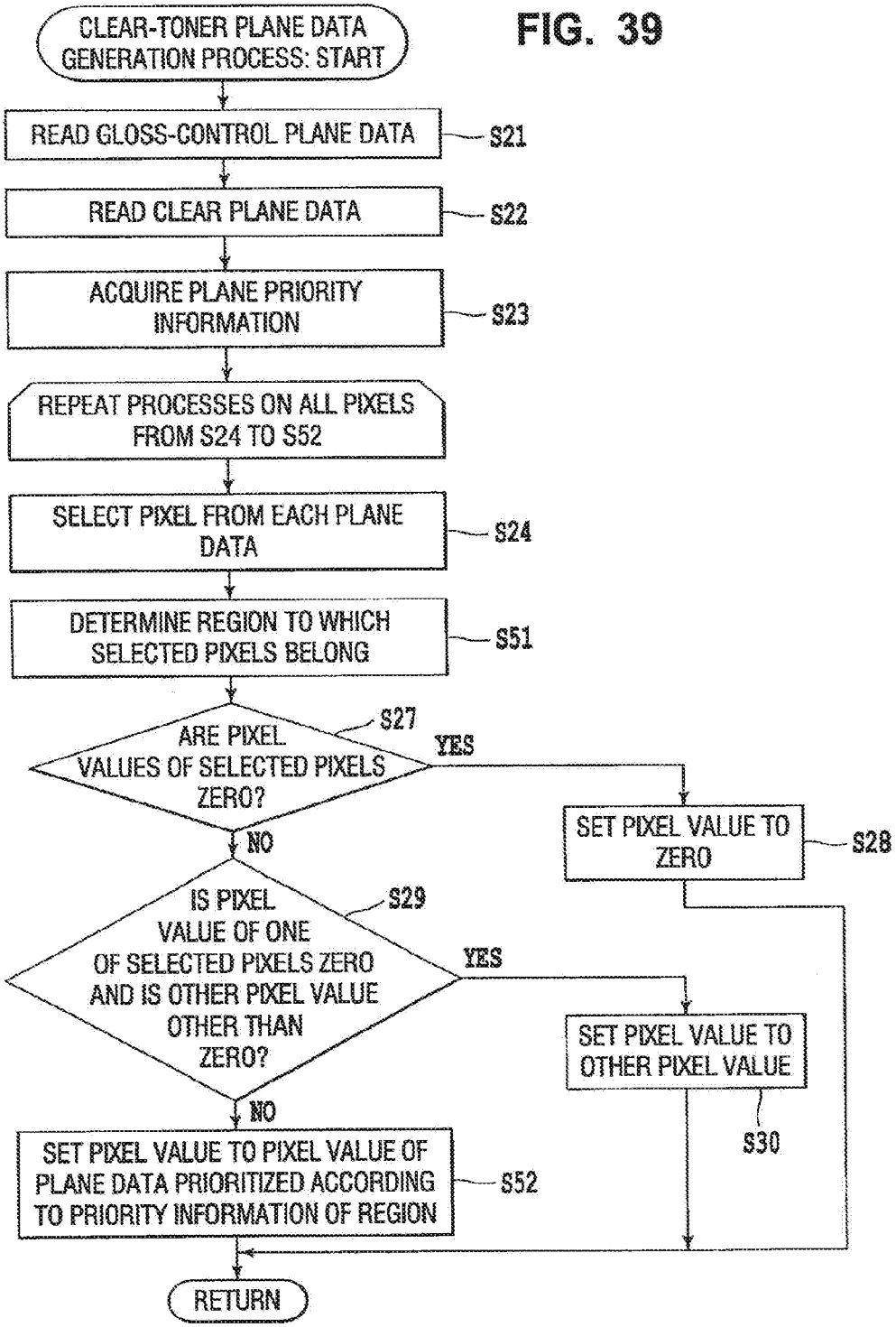
FIG. 39 is a flowchart of a procedure of a clear-toner plane data generation process according to the third embodiment.

A clear-toner plane data generation process of the present embodiment with the above configuration will be explained below. FIG. 39 is a flowchart of a procedure of the clear-toner plane data generation process according to the third embodiment.

The processes from Step S21 to Step S29 and Step S30 are the same as those of the first embodiment. In the present embodiment, after a pixel is selected from each plane data at Step S24, a region to which the selected pixels belong is determined (Step S51). Then, as in the first embodiment, the processes from Step S27 to Step S30 are performed. In the present embodiment, when it is not the case that one of the pixel values of the selected pixels is zero and the other of the pixel values of the selected pixels is other than zero at Step S29 (NO at Step S29), it is determined that the selected pixels are in the overlapping area, and the generating unit 1412 sets a pixel value of a corresponding pixel of the clear-toner plane data to the pixel value of the plane data that is prioritized in accordance with the plane priority information (priority specification) corresponding to the region to which the pixel belongs, which is determined at Step S51 (Step S52).

The processes from Step S21 to Step S52 are repeated on all of the pixels in the gloss-control plane data and the clear plane data. Consequently, the clear-toner plane data is generated, whose pixel values are set to the pixel values of the plane data prioritized according to the priority order specified in the plane priority information in the overlapping area.

Figure 40:
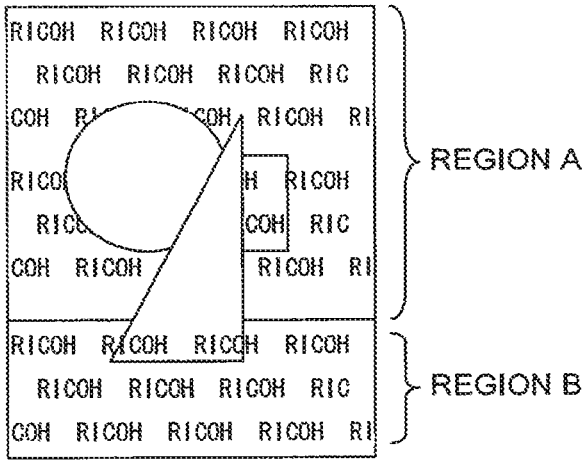
FIG. 40 is a diagram illustrating an example of a printed matter that is output through the process according to the third embodiment.

FIG. 40 is a diagram illustrating an example of a printed matter that is output through the process according to the third embodiment. As illustrated in FIG. 40, in the printed matter, corporate logos are printed as a watermark and simple graphics are placed on the corporate logos. While the corporate logos are actually transparent and glossy, they are colored in black in FIG. 40 for convenience of explanation. In FIG. 40, the gloss-control plane data is uniformly prioritized in the region A, so that all corporate logos at portions where the matt effect is applied to the simple graphics are not printed. In FIG. 40, the clear plane data is uniformly prioritized (the watermark is prioritized) in the region B, so that the corporate logos are printed all over the region without being influenced by the matt effect applied to the simple graphics.

As described above, according to the third embodiment, a user is allowed to specify a region and specify whether to give priority to the clear plane data or the gloss-control plane data in the region, and a pixel value of the clear-toner plane data is set to the pixel value of the plane data that is specified for each region in the plane priority information in the overlapping area, thereby generating the clear-toner plane data. Therefore, it is possible to consistently ensure a transparent image, such as a watermark, or to ensure the surface effect of a color image, in each region as desired by the user. As a result, it is possible to improve the convenience of users.

Fourth Embodiment

In the first to the third embodiments, the host device 10 includes the plane-data generating unit 122 and the print-data generating unit 123 while the DFE 50 includes the clear processing 56 such that the host device 10 performs the processes of generating the color image data, the clear plane data, the gloss-control plane data, and the print data and the DFE 50 performs the process of generating the clear-toner plane data. However, the present invention is not limited to the above embodiments.

Specifically, any of the processes performed by a single device may be performed by one or more other devices connected to the single device via a network.

For example, an image forming system of a fourth embodiment implements a part of the functions of the host device and the DFE on a server device connected to a network.

Figure 41:
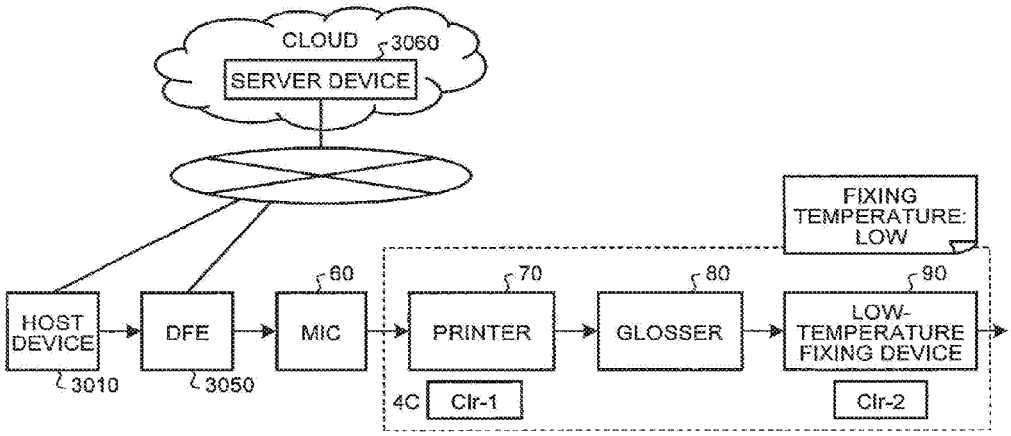
FIG. 41 is a diagram of a configuration example of an image forming system according to a fourth embodiment.

FIG. 41 is a diagram of a configuration example of the image forming system according to the fourth embodiment. As illustrated in FIG. 41, the image forming system of the present embodiment includes a host device 3010, a DFE 3050, the MIC 60, the printer 70, the glosser 80, the low-temperature fixing device 90, and a server device 3060 on the cloud. The post processing device is not limited to the glosser 80 or the low-temperature fixing device 90.

In the present embodiment, the host device 3010 and the DFE 3050 are connected to the server device 3060 via a network, such as the Internet. In the present embodiment, the plane-data generating unit and the print-data generating unit of the host device 10 of the first embodiment and the clear processing of the DFE 50 of the first embodiment are provided in the server device 3060.

The connection configuration of the host device 3010, the DFE 3050, the MIC 60, the printer 70, the glosser 80, and the low-temperature fixing device 90 is the same as that of the first embodiment.

Specifically, in the fourth embodiment, the host device 3010 and the DFE 3050 are connected to the server device 3060 via the network (cloud), such as the Internet. The server device 3060 includes a plane-data generating unit 3062, a print-data generating unit 3063, and a clear processing 3066 and performs the processes of generating the color plane data, the clear plane data, the gloss-control plane data, the print data, and the clear-toner plane data.

Figure 42:
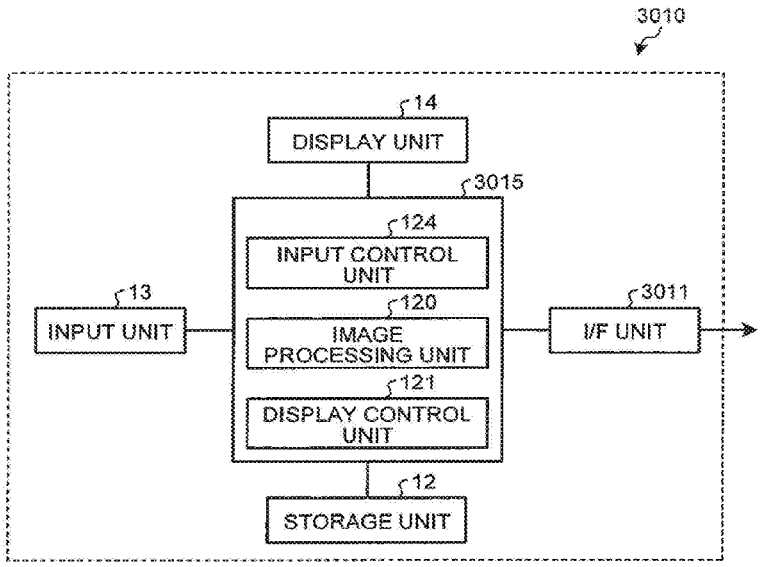
FIG. 42 is a block diagram of a functional configuration of a host device according to the fourth embodiment.

The host device 3010 of the present embodiment will be explained below. FIG. 42 is a block diagram of a functional configuration of the host device 3010 according to the fourth embodiment. As illustrated in FIG. 42, the host device 3010 of the present embodiment includes an I/F unit 3011, the storage unit 12, the input unit 13, the display unit 14, and a control unit 3015. The I/F unit 3011 is an interface device for communicating with the server device 3060 and the DFE 3050. The functions and the configurations of the storage unit 12, the input unit 13, and the display unit 14 are the same as those of the host device 10 of the first embodiment.

The control unit 3015 is a computer that controls the entire host device 3010 and includes a CPU, a ROM, a RAM, and the like. As illustrated in FIG. 42, the control unit 3015 mainly includes the input control unit 124, the image processing unit 120, and the display control unit 121. The input control unit 124 and the display control unit 121 are realized by causing the CPU of the control unit 3015 to read a program of an operating system stored in the ROM etc. and to load and execute the program on the RAM. The image processing unit 120 is realized by causing the CPU of the control unit 3015 to read a program of the above-described image processing application stored in the RAM etc. and to load and execute the program on the RAM. At least a part of the above units may be realized by an individual circuit (hardware). The functions and the configurations of the input control unit 124, the display control unit 121, and the image processing unit 120 are the same as those of the first embodiment. Therefore, similarly to the first embodiment, the plane priority information is specified by a user and is sent to the DFE 3050.

In the host device 3010 of the embodiment, similarly to the first embodiment, the input control unit 124 receives image specification information, which specifies an image, i.e., color plane data (a target image), to which the surface effect is applied from among the images (e.g., a photograph, a character, a graphic, or a composite image containing a photograph, a character and a figure) stored in the storage unit 12; and receives specification information, which contains specification of a region to which a surface effect is applied and the type of the surface effect and specification of a transparent image, such as a watermark or a texture, and a region to which the transparent image is applied, through an operation performed by a user using the input unit 13 while checking the target image displayed on the display unit 14. Among the pieces of the specification information, the server device 3060 generates the gloss-control plane data based on the specification of the region to which the surface effect is applied and the type of the surface effect. Among the pieces of the specification information, the server device 3060 generates the clear plane data based on the specification of the transparent image, such as a watermark or a texture, and the region to which the transparent image is applied. The generation of each plane data will be explained later.

In the following, the specification of the region to which the surface effect is to be applied and the type of the surface effect among the pieces of the specification information may simply be described as "specification of the surface effect". Furthermore, the specification of the transparent image, such as a watermark or a texture, and the region to which the transparent image is applied among the pieces of the specification information may simply be described as "specification of the transparent image".

The I/F unit 3011 sends a print-data generation request to the server device 3060 together with the image specification information and the specification information. The I/F unit 3011 receives, from the server device 3060, print data that is generated by the server device 3060 in response to the generation request. The gloss-control plane data, the color plane data, and the clear plane data are the same as those of the first embodiment. The print data is obtained by integrating the color plane data, the gloss-control plane data, the clear plane data, and a job command, and is the same as the print data of the first embodiment described with reference to FIG. 11.

Figure 43:
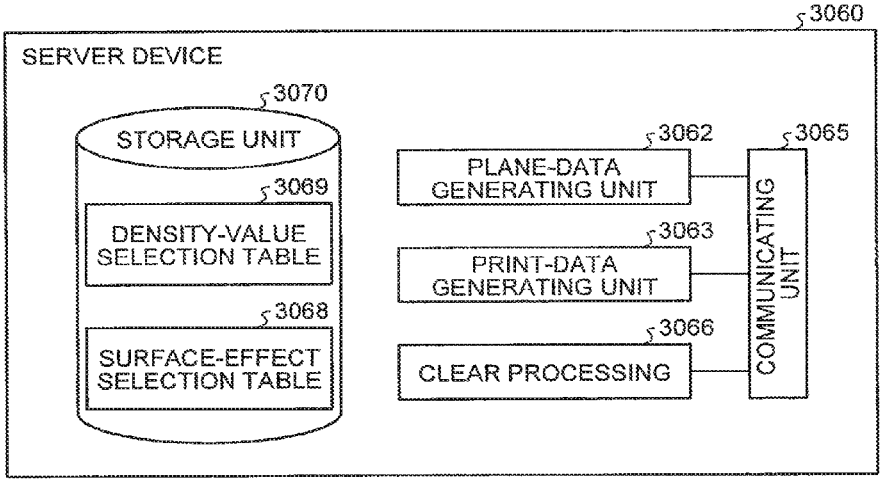
FIG. 43 is a block diagram of a functional configuration of a server device according to the fourth embodiment.

The server device 3060 will be explained below. FIG. 43 is a block diagram of a functional configuration of the server device 3060 according to the fourth embodiment. As illustrated in FIG. 43, the server device 3060 mainly includes a storage unit 3070, the plane-data generating unit 3062, the print-data generating unit 3063, the clear processing 3066, and a communicating unit 3065.

The storage unit 3070 is a storage medium, such as an HDD or a memory, and stores therein a density-value selection table 3069 and a surface-effect selection table 3068. The density-value selection table 3069 is the same as the density-value selection table of the first embodiment described with reference to FIG. 10. The surface-effect selection table 3068 is the same as the surface-effect selection table of the first embodiment described with reference to FIG. 16.

The communicating unit 3065 transmits and receives various types of data and requests to and from the host device 3010 and the DFE 3050. Specifically, the communicating unit 3065 receives the image specification information, the specification information, and the print-data generation request from the host device 3010, and transmits the generated print data to the host device 3010. The communicating unit 3065 also receives the 8-bit gloss-control plane data, the 8-bit color plane data, and the clear-toner plane data generation request from the DFE 3050, and transmits the generated clear-toner plane data and the on-off information to the DFE 3050.

The plane-data generating unit 3062 has the same functions as those of the plane-data generating unit of the host device 10 of the first embodiment, and generates the color plane data, the gloss-control plane data, and the clear plane data.

Specifically, the plane-data generating unit 3062 generates the color plane data based on the image specification information. That is, when the image specification information contains user's specification of a color of a drawing object in a target image, the plane-data generating unit 3062 generates the color plane data in accordance with the specification of the color.

When the specification information contains specification of a transparent image, such as a watermark or a texture, other than the surface effect and specification of a region to which the transparent image is applied, the plane-data generating unit 3062 generates the clear plane data for identifying the transparent image and the region to which the transparent image is applied on a sheet of paper, in accordance with the user's specification contained in the specification information.

The plane-data generating unit 3062 generates, by referring to the density-value selection table 3069, the gloss-control plane data, in which a region to which the surface effect is applied on the sheet and the type of the surface effect are identifiable, based on the specification of the region to which the surface effect is applied and the type of the surface effect in the specification information. The plane-data generating unit 3062 generates the gloss-control plane data, in which the region to which the surface effect represented by the gloss control value is applied is specified in units of drawing objects in the image data of a target image (see FIGS. 4 and 13).

The print-data generating unit 3063 of the present embodiment generates the print data as illustrated in FIG. 11 similarly to the print-data generating unit of the host device 10 of the first embodiment.

The clear processing 3066 has the same functions as those of the clear processing of the DFE 50 of the first embodiment. Therefore, the functional configuration of the clear processing 3066 is the same as the functional configuration illustrated in FIG. 15. Specifically, the clear processing 3066 determines the surface effect corresponding to the density value (the pixel value) of each of the pixels contained in the gloss-control plane data by referring to the surface-effect selection table 3068 by using the gloss-control plane data that the communicating unit 3065 has received from the DFE 3050. Subsequently, the clear processing 3066 determines on or off of the glosser 80 based on the determination of the surface effect, appropriately generates an inverse mask or a solid mask by using the received color plane data of 8 bits each of CMYK, and appropriately generates the 2-bit clear-toner plane data for attaching the clear toner. Thereafter, the clear processing 3066 appropriately generates the clear-toner plane data used by the printer 70 and the clear-toner plane data used by the low-temperature fixing device 90 based on the determination result of the surface effect, outputs the generated pieces of the plane data, and generates on-off information indicating on or off of the glosser 80.

Similarly to the first to the third embodiments, when the clear processing 3066 generates the clear-toner plane data, if the overlap determining unit 1411 determines that there is an overlapping area of a region where the density value (the gloss control value) is specified in the gloss-control plane data and a region where the density value is specified in the clear plane data, the clear processing 3066 sets, in the overlapping area, the clear-toner plane data to have either the density value specified in the gloss-control plane data or the density value specified in the clear plane data, based on the plane priority information.

Figure 44:
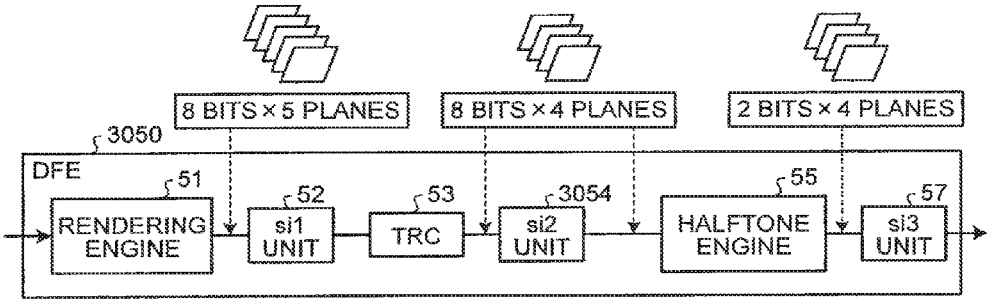
FIG. 44 is a block diagram of a functional configuration of a DFE according to the fourth embodiment.

The DFE 3050 will be explained below. FIG. 44 is a block diagram of a functional configuration of the DFE 3050 of the fourth embodiment. The DFE 3050 of the fourth embodiment mainly includes the rendering engine 51, the si1 unit 52, the TRC 53, an si2 unit 3054, the halftone engine 55, and the si3 unit 57. The functions and the configurations of the rendering engine 51, the si1 unit 52, the TRC 53, the halftone engine 55, and the si3 unit 57 are the same as those of the DFE 50 of the first embodiment.

The si2 unit 3054 of the present embodiment sends the 8-bit gloss-control plane data obtained by the gamma correction performed by the TRC 53, the 8-bit CMYK plane data, and the clear-toner plane data generation request to the server device 3060, and receives the clear-toner plane data and the on-off information from the server device 3060.

Figure 45:
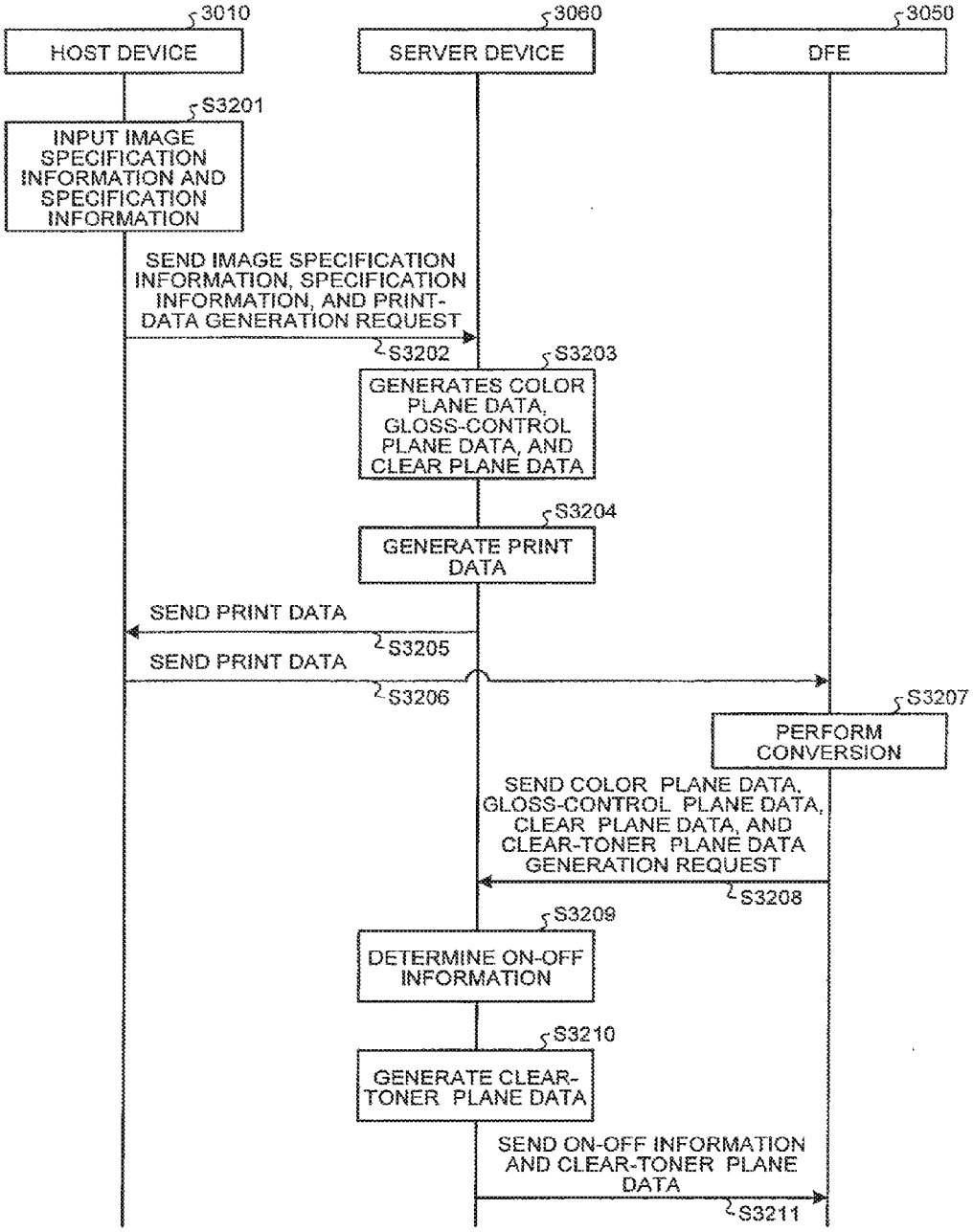
FIG. 45 is a sequence diagram of the overall flow of a clear-toner plane data generation process according to the fourth embodiment.

An explanation is given of a process of generating the clear-toner plane data that is needed for a printing process performed by the image forming system configured as above in the present embodiment. The overall flow of the clear-toner plane data generation process is explained below. FIG. 45 is a sequence diagram of the overall flow of the clear-toner plane data generation process according to the fourth embodiment.

The host device 3010 receives input of image specification information and specification information from a user (Step S3201), and sends the print-data generation request to the server device 3060 together with the image specification information and the specification information (Step S3202).

The server device 3060 receives the image specification information, the specification information, and the print-data generation request, and generates color plane data, gloss-control plane data, and clear plane data (Step S3203). The server device 3060 generates print data based on the generated pieces of the planeimage data (Step S3204), and sends the generated print data to the host device 3010 (Step S3205).

When receiving the print data, the host device 3010 sends the print data to the DFE 3050 (Step S3206).

When receiving the print data from the host device 3010, the DFE 3050 analyzes the print data to obtain the color plane data, the gloss-control plane data, and the clear plane data, and performs conversion or correction on the pieces of the plane data (Step S3207). The DFE 3050 sends the color plane data, the gloss-control plane data, the clear plane data, and the clear-toner plane data generation request to the server device 3060 (Step S3208).

When receiving the color plane data, the gloss-control plane data, the clear plane data, and the clear-toner plane data generation request, the server device 3060 determines on-off information (Step S3209), and generates clear-toner plane data (Step S3210). The server device 3060 sends the generated clear-toner plane data to the DFE 3050 (Step S3211).

Figure 46:
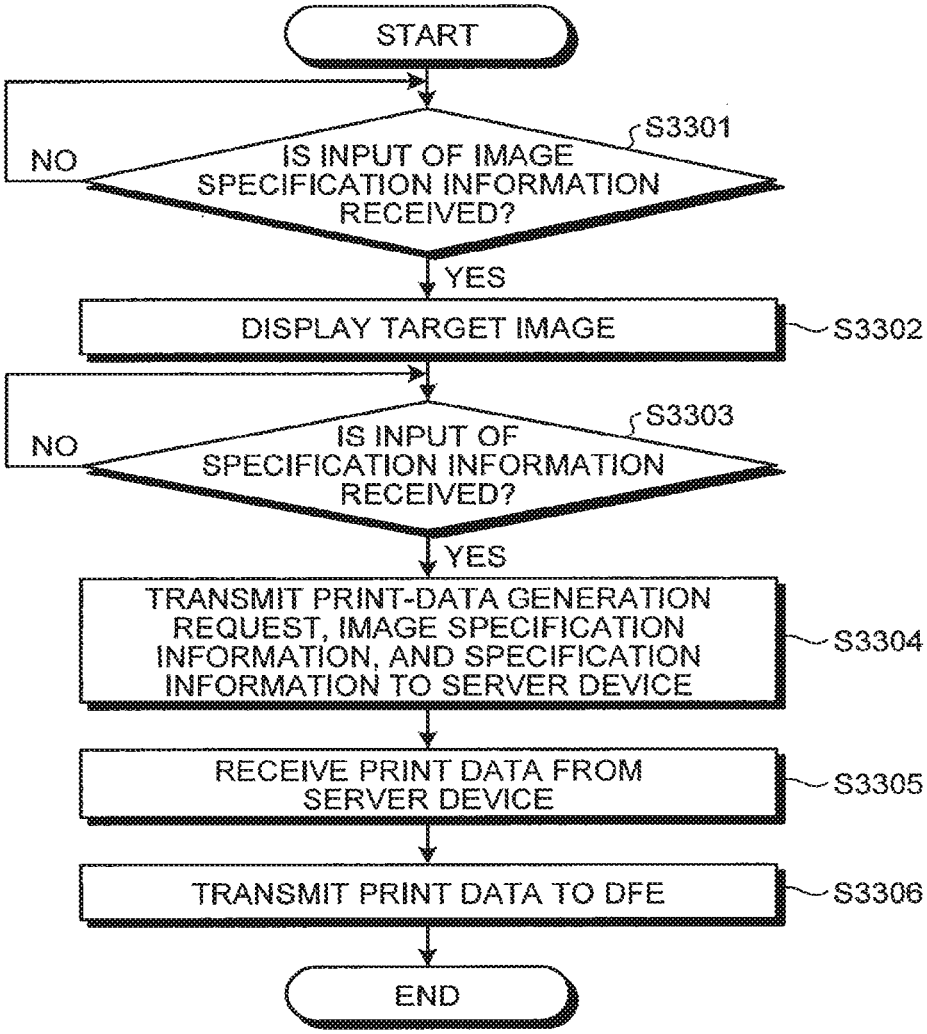
FIG. 46 is a flowchart of a procedure of a process performed by the host device according to the fourth embodiment.

Detailed processes cooperatively performed by the host device 3010, the server device 3060, the DFE 3050 in the overall process described above will be explained below. First, processes of generating the gloss-control plane data and the print data by the host device 3010 and the server device 3060 will be explained. FIG. 46 is a flowchart of a procedure of the process performed by the host device 3010 of the fourth embodiment.

When the input control unit 124 receives input of the image specification information (YES at Step S3301), the display control unit 121 causes the display unit 14 to display an image specified by the received image specification information (Step S3302). When the input control unit 124 receives input of the specification information of the surface effect or the transparent image (YES at Step S3303), the I/F unit 3011 transmits the print-data generation request to the server device 3060 together with the input image specification information and the input specification information (Step S3304).

When the server device 3060 generates the print data, the I/F unit 3011 receives the print data (Step S3305). The I/F unit 3011 transmits the print data to the DFE 3050 (Step S3306).

Figure 47:
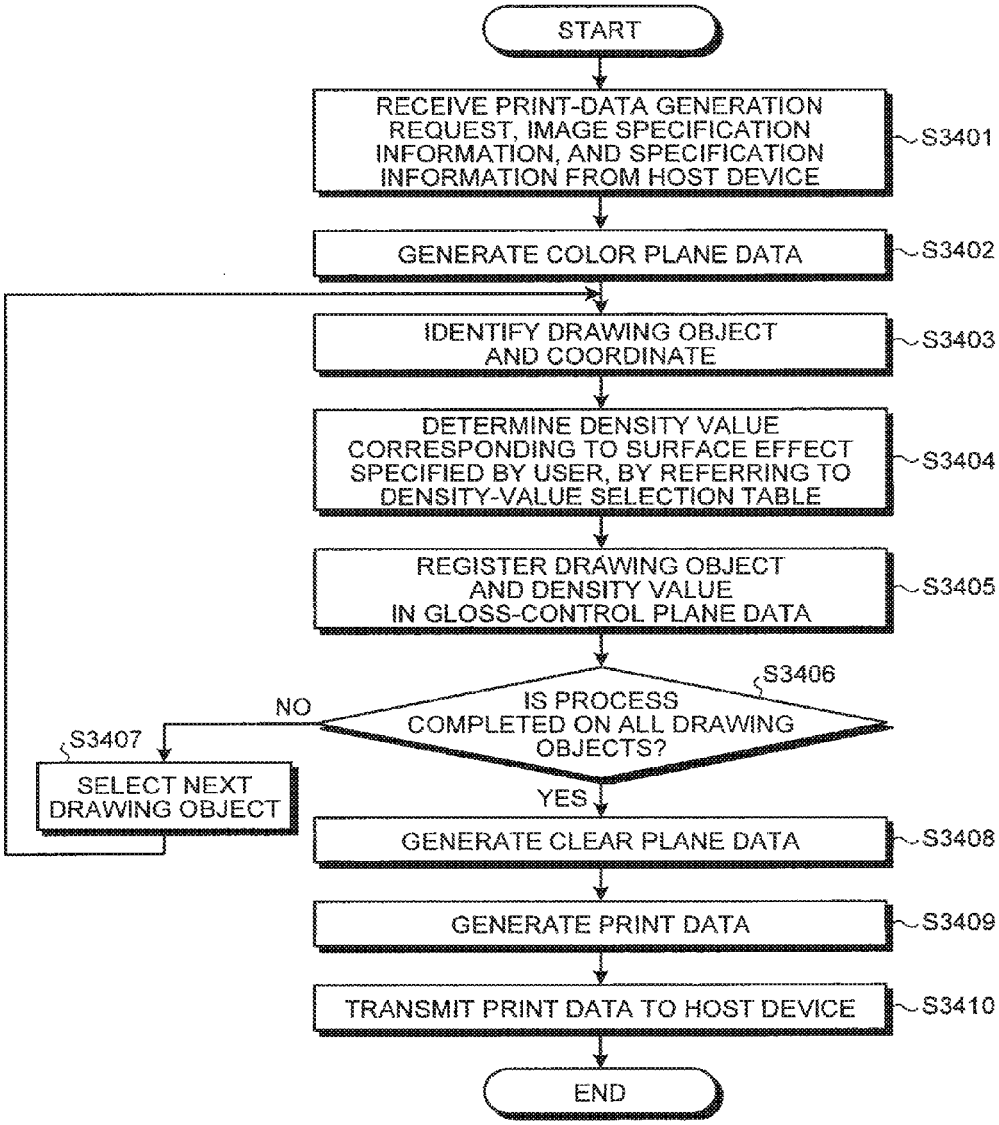
FIG. 47 is a flowchart of a procedure of a gloss-control plane data generation process and a print-data generation process performed by the server device according to the fourth embodiment.

FIG. 47 is a flowchart of a procedure of a gloss-control plane data generation process and a print-data generation process performed by the server device 3060 of the fourth embodiment. When the communicating unit 3065 receives the print-data generation request, the image specification information, and the specification information from the host device 3010 (Step S3401), the plane-data generating unit 3062 generates color plane data based on the image specification information (Step S3402).

The plane-data generating unit 3062 identifies a drawing object, to which the surface effect is applied in a target image according to the specification information, and the coordinate of the drawing object by using the drawing command provided by an operation system etc. and the coordinate value set by the drawing command (Step S3403).

The plane-data generating unit 3062 determines a density value as a gloss control value corresponding to the surface effect that is applied in the specification information by the user, by referring to the density-value selection table 3069 stored in the storage unit 3070 (Step S3404).

The plane-data generating unit 3062 registers, in the gloss-control plane data (which is initially blank data), the drawing object and the density value that is determined in accordance with the surface effect, in an associated manner (Step S3405).

The plane-data generating unit 3062 determines whether the processes from Step S3402 to Step S3404 are completed on all of drawing objects contained in the target image (Step S3406). When the processes are not completed (NO at Step S3406), the plane-data generating unit 3062 selects an unprocessed drawing object in the target image (Step S3407), and repeats the processes from Step S3403 to Step S3405.

When it is determined that the processes from Step S3403 to Step S3405 are completed on all of the drawing objects contained in the target image at Step S3406 (YES at Step S3406), the generation of the gloss-control plane data is finished. As a result, the gloss-control plane data as illustrated in FIGS. 4 and 13 is obtained.

The plane-data generating unit 3062 generates clear plane data based on the specification of the transparent image in the specification information (Step S3408).

The print-data generating unit 3063 generates original data by integrating the color plane data, the gloss-control plane data, and the clear plane data and adds a job command to the integrated original data to thereby generate print data in the PDF format as illustrated in FIG. 11 (Step S3409). The communicating unit 3065 transmits the generated print data to the host device 3010 (Step S3410).

Figure 48:
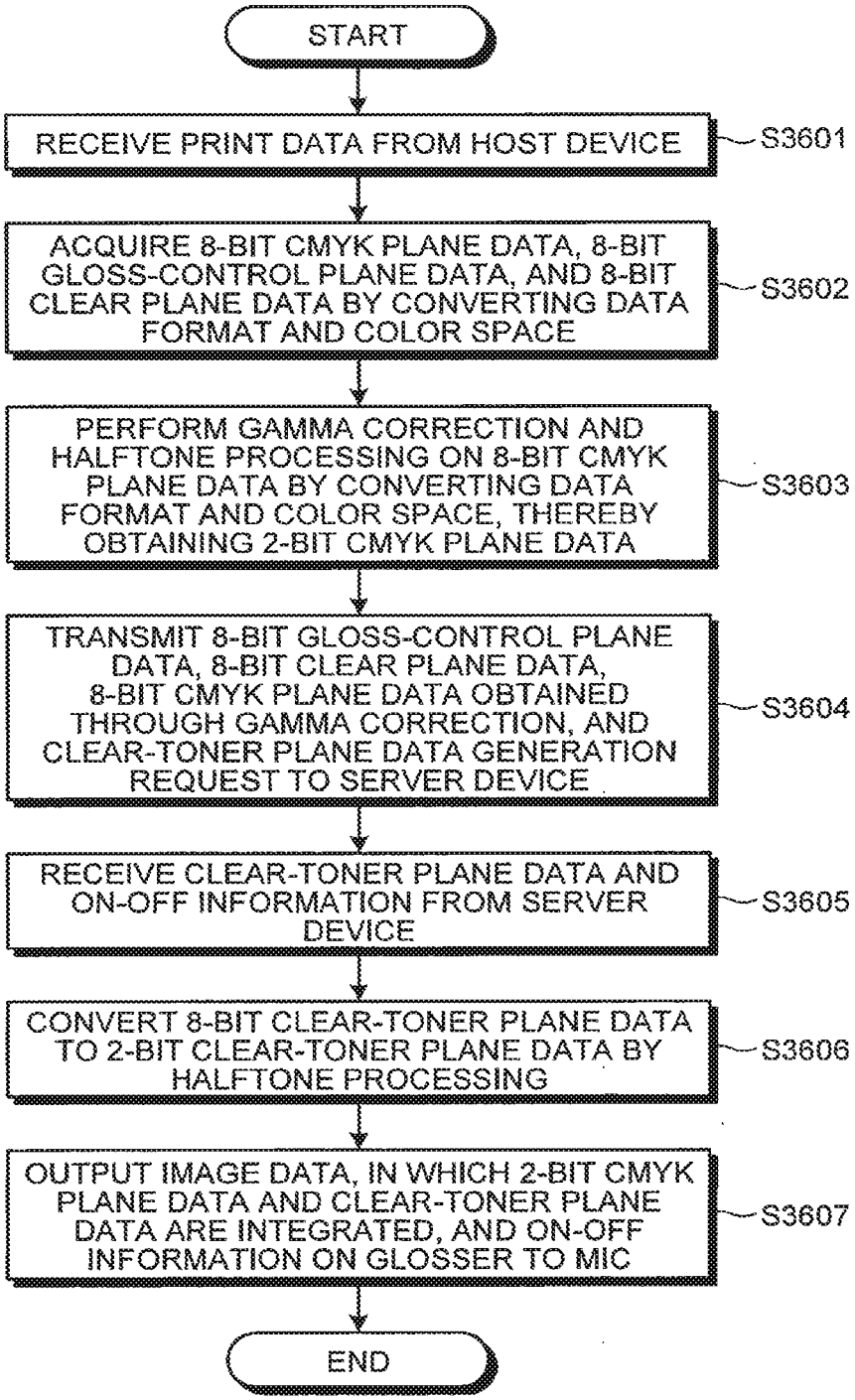
FIG. 48 is a flowchart of a procedure of a process performed by the DFE.

A clear-toner plane data generation process performed by the DFE 3050 and the server device 3060 will be explained below. FIG. 48 is a flowchart of a procedure of the process performed by the DFE 3050.

When the DFE 3050 receives the print data from the host device 3010 (Step S3601), the rendering engine 51 interprets language of the print data, converts the image data represented by the vector format to image data represented by the raster format, and converts a color space represented by an RGB format or the like to a color space represented by a CMYK format, thereby obtaining color plane data of 8 bits each of CMYK, 8-bit gloss-control plane data, and 8-bit clear plane data (Step S3602).

Details of the process of converting the gloss-control plane data at Step S3602 are the same as those of the process of converting the gloss-control plane data described in the first embodiment. Through the conversion process, the gloss-control plane data is converted to data in which the surface effect is set to each pixel.

When the 8-bit gloss-control plane data is output, the TRC 53 of the DFE 50 performs gamma correction on the color plane data of 8 bits each of CMYK by using a 1D_LUT based gamma curve generated by calibration. The halftone engine 55 performs halftone processing for converting the data format of the input image data obtained by the gamma correction, in order to obtain, for example, color plane data of 2 bits each of CMYK to be output to the printer 70, thereby obtaining the color plane data of 2 bits each of CMYK after the halftone processing (Step S3603).

The si2 unit 3054 transmits the 8-bit gloss-control plane data, the color plane data of 8 bits each of CMYK obtained through the gamma correction, the 8-bit clear plane data, and the clear-toner plane data generation request to the server device 3060 (Step S3604).

Figure 49:
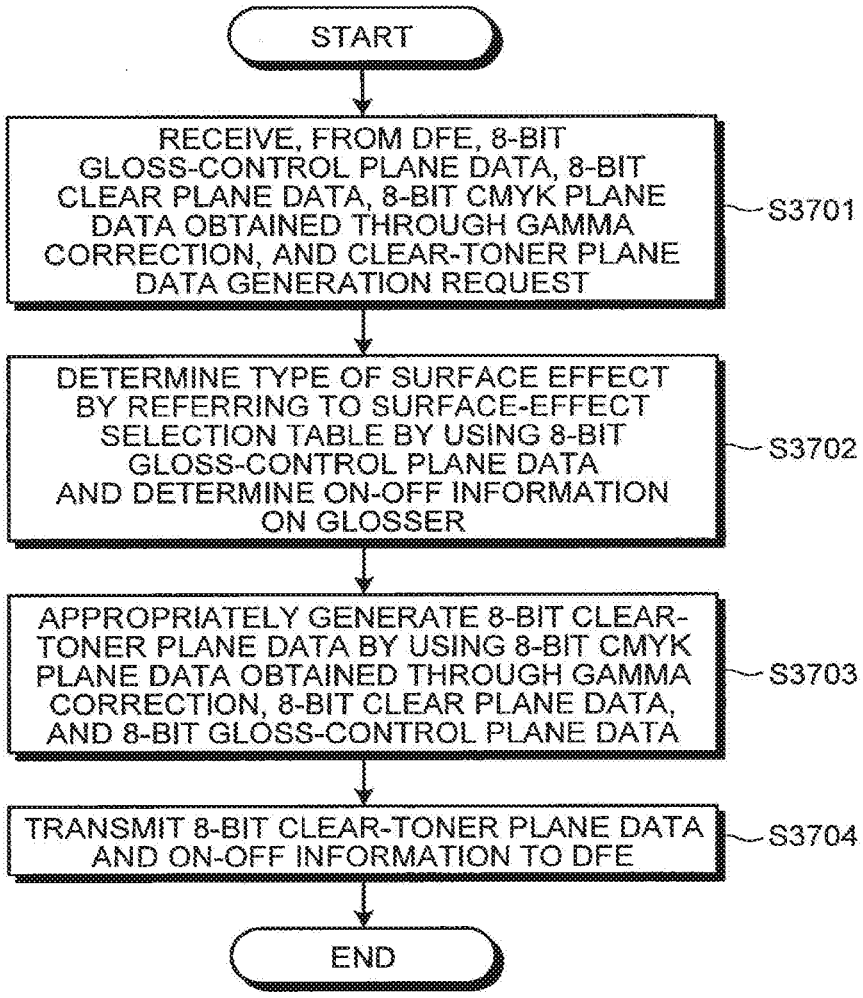
FIG. 49 is a flowchart of a procedure of a clear-toner plane data generation process performed by the server device.

A clear-toner plane data generation process performed by the server device 3060 will be explained below. FIG. 49 is a flowchart of a procedure of the clear-toner plane data generation process performed by the server device 3060.

The communicating unit 3065 of the server device 3060 receives the 8-bit gloss-control plane data, the color plane data of 8 bits each of CMYK obtained through the gamma correction, the 8-bit clear plane data, and the clear-toner plane data generation request from the DFE 3050 (Step S3701).

The clear processing 3066 determines the type of the surface effect specified for each pixel value of the gloss-control plane data by referring to the surface-effect selection table 3068 stored in the storage unit 3070 by using the 8-bit gloss-control plane data. The clear processing 3066 performs the same determination on all of the pixels contained in the gloss-control plane data. In the gloss-control plane data, all of pixels contained in a region to which the same surface effect is applied have the density values in basically the same range. Therefore, the clear processing 3066 determines that neighboring pixels, which have been determined as the same surface effect, are contained in the region to which the same surface effect is applied. In this manner, the clear processing 56 identifies the region to which the surface effect is applied and the type of the surface effect applied to the region. The clear processing 56 determines on or off of the glosser 80 in accordance with the determination of the surface effect (Step S3702).

The clear processing 3066 appropriately generates 8-bit clear-toner plane data for attaching the clear toner by appropriately using the color plane data of 8 bits each of CMYK obtained through the gamma correction, the 8-bit gloss-control plane data, and the 8-bit clear plane data (Step S3703). Therefore, the 8-bit clear-toner plane data and the on-off information are generated by the server device 3060 side.

The communicating unit 3065 transmits the 8-bit clear-toner plane data and the on-off information generated by the clear processing 3066 to the DFE 3050 (Step S3704).

Referring back to FIG. 48, after the DFE 3050 has sent the clear-toner plane data generation request to the server device 3060, the si2 unit 3054 receives the 8-bit clear-toner plane data and the on-off information from the server device 3060 (Step S3605).

The halftone engine 55 performs halftone processing to convert the 8-bit clear-toner plane data based on the 8-bit image data to 2-bit clear-toner plane data (Step S3606).

The si3 unit 57 of the DFE 3050 integrates the color plane data of 2 bits each of CMYK obtained through the halftone processing at Step S3603 and the 2-bit clear-toner plane data generated at Step S3606, and outputs the integrated image data and the on-off information, which indicates on or off of the glosser 80 and which is received at Step S3605, to the MIC 60 (Step S3607).

When the server device 3060 does not generate the clear-toner plane data, only the color plane data of 2 bits each of CMYK obtained through the halftone processing at Step S3603 are integrated at Step S3607 and outputs the integrated image data to the MIC 60.

The subsequent processes are performed by the MIC 60, the printer 70, the glosser 80, and the low-temperature fixing device 90 in the same manner as described in the first embodiment.

As described above, according to the present embodiment, the server device 3060 on the cloud generates the color plane data, the gloss-control plane data, the clear plane data, the print data, and the clear-toner plane data. Therefore, even when a plurality of the host devices 3010 and the DFEs 3050 are provided, there is an advantage in that it becomes possible to collectively change the correction-value selection table or the surface-effect selection table, in addition to the same advantage as described in the first embodiment. As a result, it is possible to the convenience of administrators of the systems or the devices.

In the present embodiment, the server device 3060 includes the plane-data generating unit 3062, the print-data generating unit 3063, and the clear processing 3066, and performs the image-data generation process of generating the color plane data, the clear plane data, and the gloss-control plane data, the print-data generation process, and the clear-toner plane data generation process; however, the present invention is not limited thereto.

Figure 50:
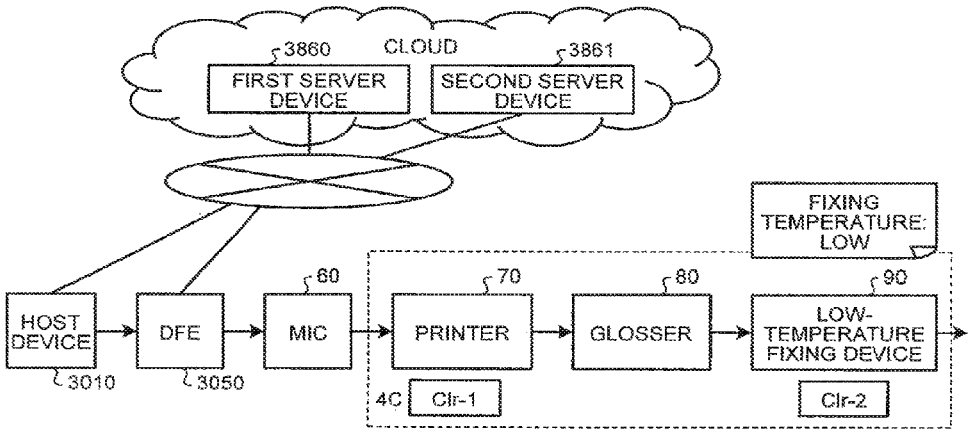
FIG. 50 is a diagram of a network configuration when two servers (a first server device and a second server device) are provided on the cloud.

For example, it may be possible to provide two or more server devices on the cloud and distribute the above processes between the two or more server devices. FIG. 50 is a diagram of a network configuration when two servers (a first server device 3860 and a second server device 3861) are provided on the cloud. In the example in FIG. 50, the first server device 3860 and the second server device 3861 performs the image-data generation process of generating the color plane data, the clear plane data, and the gloss-control plane data, the print-data generation process, and the clear-toner plane data generation process in a distributed manner.

For example, the first server device 3860 may include the plane-data generating unit 3062 and the print-data generating unit 3063 so as to perform the image-data generation process and the print-data generation process and the second server device 3861 may include the clear processing 3066 so as to perform the clear-toner plane data generation process. The way to distribute the processes between the server devices is not limited to the above but the processes may arbitrarily be distributed.

Specifically, if the host device 3010 has the minimum configuration including, for example, the input unit 13, the input control unit 124, the image processing unit 120, the display control unit 121, and the display unit 14, a part or the whole of the plane-data generating unit 3062, the print-data generating unit 3063, and the clear processing 3066 may collectively be provided in one server on the cloud or may be distributed between a plurality of server devices in an arbitrary manner.

In other words, as illustrated in the above example, any of the processes performed by a single device may be performed by one or more other devices connected to the single device via a network.

In the case that "any of the processes is performed by one or more other devices connected to the single device via a network", the following processes may be involved: a process of outputting data (information) that is generated through a process performed by one device, to the other device; a process of inputting the data by the other device; a process of inputting and outputting data between the one device and the other device; and a process of inputting and outputting data between the other devices.

Specifically, when one device is provided as the other device, the process of inputting and outputting data between the one device and the other device is involved. When two or more other devices are provided, the process of inputting and outputting data between the one device and the other devices or between the other devices, e.g., between a first device and a second device.

In the fourth embodiment, the server device 3060 or a plurality of server devices, such as the first server device 3860 and the second server device 3861, is provided on the cloud; however, the present invention is not limited thereto. For example, the server device 3060 or the server devices, such as the first server device 3860 and the second server device 3861, may be provided on any network, such as an intranet.

Figure 51:
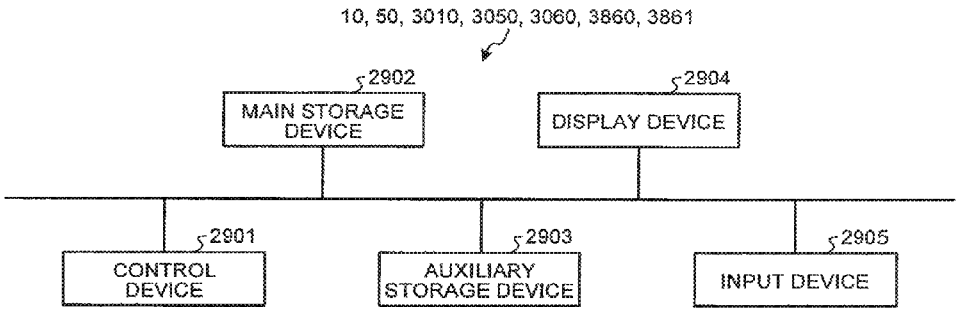
FIG. 51 is a diagram of a hardware configuration of the host devices and the server devices.

The hardware configuration of each of the host devices 10 and 3010, the DFEs 50 and 3050, the server device 3060, the first server device 3860, and the second server device 3861 described in the above embodiments will be explained below. FIG. 51 is a hardware configuration of each of the host devices 10 and 3010, the DFEs 50 and 3050, the server device 3060, the first server device 3860, and the second server device 3861. Each of the host devices 10 and 3010, the DFEs 50 and 3050, the server device 3060, the first server device 3860, and the second server device 3861 mainly includes, as the hardware configuration using a normal computer, a control device 2901, such as a CPU, for controlling the entire device; a main storage device 2902, such as a ROM or a RAM, for storing various types of data and various programs; an auxiliary storage device 2903, such as an HDD, for storing various types of data and various programs; an input device 2905, such as a keyboard or a mouse; and a display device 2904, such as a display device.

An image processing program (including the image processing application: the same is applied in the following) executed by the host device 10 or 3010 of the embodiments is recorded in a computer-readable recording medium, such as a CD-ROM, a flexible disk (FD), a CD-R, or a digital versatile disk (DVD), in a computer-installable or a computer-executable format, and provided as a computer program product.

The image processing program executed by the host device 10 or 3010 of the embodiments may be stored in a computer connected to a network, such as the Internet, and provided by being downloaded via the network. The image processing program executed by the host devices 10 and 3010 of the embodiments may be provided or distributed via the network, such as the Internet.

The image processing program executed by the host device 10 or 3010 of the embodiments may be provided by being installed in a ROM or the like in advance.

The image processing program executed by the host device 10 or 3010 of the embodiments has a module structure made up of the above units (the image processing unit, the plane-data generating unit, the print-data generating unit, the input control unit, and the display control unit). As actual hardware, a CPU (processor) reads the image processing program from the storage medium and executes the image processing program to load the above units on the main storage device, so that the image processing unit, the plane-data generating unit, the print-data generating unit, the input-control unit, and the display control unit are generated on the main storage device.

The print control process performed by the DFE 50 or 3050 of the embodiments may be realized by hardware or software as a print control program. In this case, the print control program executed by the DFE 50 or 3050 of the embodiments is provided by being installed in a ROM or the like.

The print control program executed by the DFE 50 or 3050 of the embodiments may be recorded in a computer-readable recording medium, such as a CD-ROM, an FD, a CD-R, or a DVD, in a computer-installable or a computer-executable format, and provided as a computer program product.

The print control program executed by the DFE 50 or 3050 of the embodiments may be stored in a computer connected to a network, such as the Internet, and provided by being downloaded via a network. The print control program executed by the DFE 50 or 3050 of the embodiments may be provided or distributed via a network, such as the Internet.

The print control program executed by the DFE 50 or 3050 of the embodiments has a module structure made up of the above units (the rendering engine, the halftone engine, the TRC, the si1 unit, the si2 unit, the si3 unit, and the clear processing). As actual hardware, a CPU (processor) reads and executes the print control program from the ROM to load the above units on the main storage device, so that the rendering engine, the halftone engine, the TRC, the si1 unit, the si2 unit, the si3 unit, and the clear processing are generated on the main storage device.

The data generation processes performed by the server device 3060 of the embodiments may be realized by hardware or software as a generation program. In this case, the generation program executed by the server device 3060 of the embodiments is provided by being installed in a ROM or the like.

A program of the data generation process executed by the server device 3060 of the embodiments may be recorded in a computer-readable recording medium, such as a CD-ROM, an FD, a CD-R, or a DVD, in a computer-installable or a computer-executable format, and provided as a computer program product.

The program of the data generation process executed by the server device 3060 of the embodiments may be stored in a computer connected to a network, such as the Internet, and provided by being downloaded via the network. The program of the data generation process executed by the server device 3060 of the embodiments may be provided or distributed via a network, such as the Internet.

The program of the data generation process executed by the server device 3060 has a module structure made up of the above units (the plane-data generating unit, the print-data generating unit, and the clear processing). As actual hardware, a CPU (processor) reads and executes the generation program from the ROM to load the above units on the main storage device, so that the plane-data generating unit, the print-data generating unit, and the clear processing are generated on the main storage device.

The present invention is not limited to the specific details and representative examples described in the above embodiments. Accordingly, the present invention may be embodied by changing, altering, or modifying various elements within the scope of the present invention. Furthermore, various inventions may be made by combining the elements described in the above embodiments. For example, a part of the elements may be removed from the whole of the elements described in the embodiments or the elements described in different embodiments may appropriately be integrated. Moreover, various modifications may be made as described below by way of example.

In the embodiments described above, the image forming system includes the host device 10 or 3010, the DFE 50 or 3050, the MIC 60, the printer 70, the glosser 80, and the low-temperature fixing device 90; however the configuration is not limited thereto. For example, it may be possible to construct one image forming device by integrating the DFEs 50 and 3050, the MIC 60, and the printer 70 or it may be possible to construct an image forming device that includes the DFEs 50 and 3050, the MIC 60, the printer 70, the glosser 80, and the low-temperature fixing device 90. Furthermore, the host device 10 or 3010 and the DFE 50 may be configured as a single device.

In the image forming system of the embodiments described above, a plurality of color toners, i.e., CMYK toners, are used for forming an image. However, it is possible to form an image by using a single color toner.

The image forming system according to the embodiments described above includes the MIC 60; however, the configuration is not limited thereto. It may be possible to provide the functions of the MIC 60 to another device, such as the DFE 50, and remove the MIC 60.

According to the embodiments, it is possible to efficiently perform exclusion control relating to a clear toner application method in an overlapping area of a region where a glossy transparent image appears and a region where the surface effect is applied in a color image.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A print control apparatus that controls a printing device, wherein the printing device stores therein a clear substance and forms an image on a recording medium based on third image data for attaching the clear substance, the print control apparatus comprising circuitry configured to:

generate the third image data based on first image data and second image data, the first image data containing a first value for specifying a type of a surface effect applied to the recording medium and for specifying a region to which the surface effect is applied in the recording medium, and the second image data containing a second value for specifying a transparent image other than the surface effect, wherein when the region where the first value is specified in the first image data and another region where the second value is specified in the second image data overlap each other, the circuitry is configured to set a value of the third image data to either the first value specified in the first image data or the second value specified in the second image data, based on a predetermined condition.

2. The print control apparatus according to claim 1, wherein the circuitry is configured to:

acquire plane priority information indicating whether to give priority to the first image data or the second image data, determine an overlapping area, in which the region where the first value is specified in the first image data and the another region where the second value is specified in the second image data overlap each other, and generate the third image data of the overlapping area based on either the first image data or the second image data as specified in the plane priority information.

3. The print control apparatus according to claim 2, wherein when the plane priority information indicates that priority is given to the first image data, the circuitry is configured to generate the third image data by setting the value of the overlapping area of the third image data to the first value of the overlapping area of the first image data, and when the plane priority information indicates that priority is given to the second image data, the circuitry is configured to generate the third image data by setting the value of the overlapping area of the third image data to the second value of the overlapping area of the second image data.

4. The print control apparatus according to claim 2, wherein the plane priority information contains priority order among the second image data and one or more surface effects that can be specified in the first image data, and the circuitry is configured to generate the third image data by selecting the first value or the second value in accordance with the priority order specified in the plane priority information and to set the value of the third image data in the overlapping area to the selected first or second value.

5. The print control apparatus according to claim 2, wherein the plane priority information contains a plurality of priority orders, and the circuitry is configured to generate the third image data by selecting the first value or the second value in accordance with a priority order specified by a user among the plurality of priority orders specified in the plane priority information and to set the value of the third image data in the overlapping area to the selected first or second value.

6. The print control apparatus according to claim 2, wherein the plane priority information contains specification of whether to give priority to the first image data or the second image data for each of a plurality of regions in the recording medium, and the circuitry is configured to generate the third image data based on either the first image data or the second image data as specified in the plane priority information for a corresponding region.

7. The print control apparatus according to claim 1, wherein the predetermined condition is specified by a user.

8. A printing system comprising:

an information processing apparatus;

a printing device; and a print control apparatus that is connected to the information processing apparatus and the printing device via a network and controls the printing device, wherein the information processing apparatus includes first circuitry configured to:

receive specification of a type of a surface effect and specification of a region to which the surface effect is applied, with respect to image data to be input, and generate first image data and second image data in accordance with the received specification, the first image data and the second image data being used to generate third image data to attach a clear substance to a recording medium, the first image data containing a first value for specifying the type of the surface effect applied to the recording medium and for specifying the region to which the surface effect is applied in the recording medium, and the second image data containing a second value for specifying a transparent image other than the surface effect, the print control apparatus includes second circuitry configured to generate the third image data based on the first image data and the second image data, when the region where the first value is specified in the first image data and another region where the second value is specified in the second image data overlap each other, the second circuitry is configured to set a value of the third image data to either the first value specified in the first image data or the second value specified in the second image data, based on a predetermined condition, and the printing device stores therein the clear substance and forms an image on the recording medium based on the third image data.

9. The printing system according to claim 8, wherein the first circuitry is configured to receive plane priority information indicating whether to give priority to the first image data or the second image data, the second circuitry is configured to determine an overlapping area, in which the region where the first value is specified in the first image data and the another region where the second value is specified in the second image data overlap each other, and the second circuitry is configured to generate the third image data of the overlapping area based on either the first image data or the second image data as specified in the plane priority information.

10. The printing system according to claim 9, wherein the plane priority information contains a plurality of priority orders among the second image data and one or more surface effects that can be specified in the first image data, the first circuitry is configured to receive specification of a priority order from among the plurality of priority orders from a user, and the second circuitry is configured to generate the third image data by selecting the first value or the second value in accordance with the priority order specified by the user and to set the value of the third image data in the overlapping area to the selected first or second value.

11. The printing system according to claim 10, wherein the first circuitry is configured to receive, as the plane priority information, the specification of the region in the recording medium and the specification of the priority order indicating whether to give priority to the first image data or the second image data, the specification of the priority order corresponding to a specified region, and the second circuitry is configured to generate the third image data based on either the first image data or the second image data as specified in the plane priority information for the specified region.

12. A print control method implemented by a print control apparatus that controls a printing device, wherein the printing device stores therein a clear substance and forms an image on a recording medium based on third image data for attaching the clear substance, the print control method comprising:

generating the third image data based on first image data and second image data, the first image data containing a first value for specifying a type of a surface effect applied to the recording medium and for specifying a region to which the surface effect is applied in the recording medium, and the second image data containing a second value for specifying a transparent image other than the surface effect, wherein the generating includes setting, when the region where the first value is specified in the first image data and another region where the second value is specified in the second image data overlap each other, a value of the third image data to either the first value specified in the first image data or the second value specified in the second image data, based on a predetermined condition.

* * * * *